US005422661A

United States Patent [19]

Takeuchi et al.

[11] Patent Number: 5,422,661

[45] Date of Patent: Jun. 6, 1995

[54] END-CONTACT TYPE THERMAL RECORDING HEAD HAVING HEAT-GENERATING PORTION ON THIN-WALLED END PORTION OF CERAMIC SUBSTRATE

[75] Inventors: Yukihisa Takeuchi, Aichi; Toshikazu Hirota, Nagoya, both of Japan

[73] Assignee: NGK Insulators, Ltd., Japan

[21] Appl. No.: 822,944

[22] Filed: Jan. 21, 1992

[30] Foreign Application Priority Data

| | | | |
|---|---|---|---|
| Jan. 22, 1991 | [JP] | Japan | 3-021595 |
| Sep. 28, 1991 | [JP] | Japan | 3-276662 |
| Sep. 28, 1991 | [JP] | Japan | 3-276663 |
| Oct. 3, 1991 | [JP] | Japan | 3-283495 |
| Oct. 3, 1991 | [JP] | Japan | 3-283496 |

[51] Int. Cl.[6] ..... B41J 2/335

[52] U.S. Cl. ..... 347/201

[58] Field of Search ..... 346/76 PH, 139 C, 155

[56] References Cited

U.S. PATENT DOCUMENTS

| | | | |
|---|---|---|---|
| 4,968,996 | 11/1990 | Ebihara et al. | 346/76 PH |
| 5,184,344 | 2/1993 | Takeuchi et al. | 346/76 PH |

FOREIGN PATENT DOCUMENTS

| | | |
|---|---|---|
| 0372896 | 6/1990 | European Pat. Off. . |
| 60-8081 | 1/1985 | Japan . |
| 60-24965 | 2/1985 | Japan . |
| 61-89870 | 5/1986 | Japan . |
| 61-211055 | 9/1986 | Japan . |
| 63-51156 | 3/1988 | Japan . |
| 63-237963 | 10/1988 | Japan . |

OTHER PUBLICATIONS

Patent Abstracts of Japan, vol. 3, No. 141 (E-153) Nov. 21, 1979 & JP-A-54 118 842 (Tokyo Shibaura Denki K.K.) Sep. 14, 1979.

Patent Abstracts of Japan, vol. 11, No. 86 (M-572(2533) Mar. 17, 1987 & JP-A-61 241 162 (Matsushita Electric Ind Co Ltd) Oct. 27, 1986.

*Primary Examiner*—Huan H. Tran

*Attorney, Agent, or Firm*—Parkhurst, Wendel & Rossi

[57] ABSTRACT

A thermal recording head having an electrically resistive heat-generating portion formed on an thin-walled end portion of a ceramic substrate and electrically connected to recording and return-circuit electrodes. A reinforcing or heat radiating member is disposed on at least one of opposite sides of the substrate such that a portion of the reinforcing or heat radiating member is located at the thin-walled end portion of the substrate. The thin-walled end portion is preferably partially defined by a shoulder surface which extends from one of opposite major surface of the substrate and terminates in the end face of the thin-walled end portion. The substrate preferably has a thermal conductivity within a range between 0.002 cal.cm/sec.cm$^2$.°C. and 0.03 cal.cm/sec.cm$^2$.°C., while the heat radiating member preferably has a thermal conductivity higher than 0.01 cal.cm/sec.cm$^2$.°C. The conductivity of the substrate is preferably lower than that of the heat radiating member.

20 Claims, 21 Drawing Sheets

END-CONTACT TYPE THERMAL RECORDING HEAD HAVING HEAT-GENERATING PORTION ON THIN-WALLED END PORTION OF CERAMIC SUBSTRATE

BACKGROUND OF THE INVENTION

1. Field of the Invention

The present invention relates to an end-contact type thermal recording head suitably used for printers, facsimile equipment and other recording devices, which use heat-sensitive recording media or thermally imaging ribbons, films or other intermediate media interposed between the recording head and the recording medium.

2. Discussion of the Prior Art

As a thermal recording head for a recording apparatus such as a printer and a facsimile receiver, there is known a side-contact type thermal head in which an integrated-circuit driver portion and an electrically resistive heat-generating portion are both disposed on the same side of a substrate, which corresponds to one of opposite major surfaces of the substrate. Also known is an end-contact type thermal head as disclosed in laid-open Publications 60-24965, 60-8081 and 61-40168 of unexamined Japanese Patent Applications. In the end-contact type thermal head, only the electrically resistive heat-generating portion is formed on one end face of the substrate.

In particular, the end-contact type thermal head is commonly used for various advantages over the side-contact type. These advantages include: better contact of the heat-generating portion with a heat-sensitive paper or thermal print ribbon or film; elimination of a relief portion required for the side-contact type, for avoiding a contact between the driver circuit and a platen of the recording apparatus; reduced size of the head; and easy formation of an end face having a high degree of flatness for the heat-generating portion.

For improving the quality of images recorded by the end-contact type thermal head, on the other hand, there is a need for minimizing a distance between recording electrodes and a return-circuit electrode or electrodes, which are electrically connected to electrically resistive films of the heat-generating portion. Further, the above distance should be uniform for all the recording electrodes. Since the recording and return-circuit electrodes are disposed on the opposite sides of the substrate, the thickness of the substrate should be reduced to meet the above need. However, a reduction of the substrate thickness to an extent sufficient to meet the need will lead to difficulty in handling or processing such a thin substrate, insufficient mechanical strength of the substrate, and other drawbacks. It is also recognized that the known end-contact type thermal head is not completely satisfactory in its contact characteristic or behavior and heat-generating response.

The known end-contact type thermal printing head has another drawback, which arises from its structural arrangement as shown in FIG. 38, in which the heat-generating portion 104 projects toward the heat-sensitive paper or thermal imaging ribbon or film, from a base member 108 on which is supported the thermal head assembly, is supported. Namely, the known end-contact type thermal head is generally incapable of rapidly or efficiently radiating the heat generated by the heat-generating portion, toward the base or other members of the printer, and accordingly suffers from blurring, blotting or expansion of recorded image dots, distortion of the image dots due to prolonged heat application from the heat-generating portion, and other drawbacks.

Further, the known end-contact type thermal head shown in FIG. 38 includes a glaze layer 106 formed on the end face of the substrate 102, so that the electrically resistive films of the heat-generating portion 104 are formed on the glaze layer 106. The glaze layer 106 is provided since it is difficult to obtain a sufficiently high surface finish quality of the end face. The glaze layer 106 assures improved thermal characteristic of the heat-generating portion 104, and is effective to reduce failure of electrical connection of the electrical resistive films of the heat-generating portion 104 to the recording and return-circuit electrodes 110 and 112. However, it is difficult to form the glaze layer 106 uniformly on the end face of the substrate 102. Further, there are limitations in the configurations of the substrate 102 and glaze layer 106 for obtaining desired thermal characteristic of the heat-generating portion 104. In other words, the freedom of design of the glaze layer 106 for the desired thermal characteristic of the heat-generating portion 104 is too low to attain the intended function of the glaze layer.

There is also proposed an end-contact type thermal recording head which uses a substrate having a thin-walled end portion on which the electrically resistive heat-generating portion is formed. This recording head has a problem of insufficient mechanical strength at the thin-walled end portion. This problem is serious particularly where the heat-generating portion is adapted to contact the heat-sensitive paper or thermally imaging film or ribbon under a comparatively high pressure.

SUMMARY OF THE INVENTION

It is therefore a first object of the present invention to provide an end-contact type thermal recording head which assures an improved characteristic of contact with a recording medium or thermal ribbon or film or other thermally imaging intermediate medium, and improved heat-generating response, for excellent quality of images recorded.

It is a second object of the present invention to provide an end-contact type thermal recording head which also assures sufficiently high mechanical strength at its recording end portion, and prolonged life expectancy with improved operating reliability.

A third object of the invention is to provide an end-contact type thermal recording head which assures improved heat-generating characteristics for high accuracy of image reproduction even at a comparatively high recording speed.

The first object may be achieved according to a first aspect of the present invention, which provides an end-contact type thermal recording head comprising: a ceramic substrate having a thin-walled end portion; an electrically resistive heat-generating portion formed on at least an end face of the thin-walled end portion of the ceramic substrate; a plurality of recording electrodes formed on one of opposite major surfaces of the substrate; at least one return-circuit electrode formed on the other major surface of the substrate, the recording and return-circuit electrodes being electrically connected to the heat-generating portion to energize the heat-generating portion; and a reinforcing member disposed on at least one of opposite sides of the ceramic substrate corresponding to the opposite major surfaces of the substrate, such that a portion of the reinforcing member is located at the thin-walled end portion of the ceramic substrate.

In the end-contact type thermal recording head constructed according to the first aspect of the present invention as described above, the electrically resistive heat-generating portion is formed on at least the end face of the thin-walled portion of the ceramic substrate, and the recording and return-circuit electrodes for energizing the heat-generating portion are formed on only the opposite major surfaces of the substrate. In this arrangement, the heat-generating portion can be suitably contacted with a heat-sensitive paper or other recording medium or a thermally imaging intermediate medium such as a thermally fusible ink ribbon or film, and has a high operating response. Accordingly, the present recording head is capable of performing a high-quality recording operation. Further, the reinforcing member or members provided at the thin-walled end portion of the ceramic substrate effectively reinforce the thin-walled end portion of the substrate on which the heat-generating portion is provided, whereby the mechanical strength of the recording head is increased.

The reinforcing member may be disposed in contact with a common return-circuit electrode in the form of a sheet, or the plurality of recording electrodes. Further, the two reinforcing members may be disposed on both sides of the substrate corresponding to the opposite major surfaces of the substrate.

The reinforcing member is preferably made of an easily worn material, for example, a material having at least one major component selected from the group consisting of free-cutting glass ceramic, free-cutting glass ceramic containing mica, free-cutting alumina, free-cutting boron nitride, free-cutting aluminum nitride, brass, copper, aluminum and bronze.

The thickness of the thin-walled portion of the ceramic substrate as measured at the end face is preferably held within a range of 10–90 μm, and more preferably within a range of 20–70 μm.

The first object indicated above may also be achieved according to a second aspect of the present invention, which provides an end-contact type thermal recording head comprising: a ceramic substrate having a thin-walled end portion; an electrically resistive heat-generating portion formed on at least an end face of the thin-walled end portion; recording and return-circuit electrodes formed on the substrate and electrically connected to the heat-generating portion to energize the heat-generating portion; and a heat radiating member disposed on one of opposite sides of the ceramic substrate which correspond to opposite major surfaces of the substrate, such that a portion of the heat radiating member is located at the thin-walled end portion of the ceramic substrate.

In the end-contact type thermal recording head constructed according to the second aspect of the present invention as described above, the electrically resistive heat-generating portion is formed on at least the end face of the thin-walled portion of the ceramic substrate, and the recording and return-circuit electrodes for energizing the heat-generating portion are formed on the substrate. In this arrangement, the heat-generating portion can be suitably contacted with a heat-sensitive paper or other recording medium or a thermally imaging intermediate medium such as an ink ribbon or film, and has a high operating response. Accordingly, the present recording head is capable of performing a high-quality recording operation. Further, the heat radiating member provided at the thin-walled end portion of the ceramic substrate permits the heat generated by the heat-generating portion to be rapidly radiated, whereby the recording head is capable of recording images, without blurring, blotting or expansion of recorded image dots, and without distortion of the recorded images due to prolonged heat application from the heat-generating portion to the recording medium or thermally imaging intermediate medium.

The heat radiating member may be bonded to the common return-circuit electrode in the form of a sheet. Alternatively, the heat radiating member may be disposed in contact with the recording electrodes.

The ceramic substrate is preferably made of free-cutting glass ceramic containing mica. The heat radiating member is preferably made of a material having at least one major component selected from the group consisting of free-cutting glass ceramic, free-cutting glass ceramic containing mica, free-cutting alumina, free-cutting boron nitride, free-cutting aluminum nitride, brass, copper, aluminum and bronze.

The thickness of the thin-walled portion of the ceramic substrate as measured at the end face is preferably held within a range of 10–400 μm, and more preferably within a range of 20–70 μm.

The heat-generating portion may be formed directly on the end face of the thin-walled end portion of said ceramic substrate, without a glaze layer between the heat-generating portion and the ceramic substrate.

The second object indicated above may be achieved according to a third aspect of the present invention, which provides an end-contact type thermal recording head comprising: a ceramic substrate; an electrically resistive heat-generating portion formed on the substrate; and recording and return-circuit electrodes formed on the substrate and electrically connected to the heat-generating portion to energize the heat-generating portion. The ceramic substrate has a first and a second major surface opposed to each other, and a thin-walled end portion having an end face on which the electrically resistive heat-generating portion is provided. The substrate further has a shoulder surface which extends from one of the first and second major surfaces and terminates in the end face, so as to approach progressively the other of the first and second major surfaces, thereby partially defining the thin-walled end portion.

In the end-contact type thermal recording head constructed according to the third aspect of the invention as described above, the end portion of the substrate which has the end face carrying the electrically resistive heat-generating portion is thin-walled by the provision of the shoulder surface which extends from one of the opposite major surfaces approaches the other major surface. This 10 thin-walled end portion permits good contact of the heat-generating portion with a heat-sensitive paper or a thermally imaging ribbon, film or other intermediate medium, and assures an excellent characteristic of heat transfer from the heat-generating portion to the heat-sensitive paper or intermediate medium. Further, the thin-walled end portion of the substrate has sufficient mechanical strength and can be easily reinforced by a suitable member.

The end face may be a flat surface which is substantially perpendicular to the first and second major surfaces, or inclined with respect to the other of the first and second major surfaces such that an angle between an extension of the flat surface and the other major surface is not larger than 90°. Alternatively, the end face may be a convex surface.

At least one of opposite ends of the end face at which the heat-generating portion is electrically connected to the recording and return-circuit electrodes may be rounded.

The shoulder surface may be either a flat inclined surface, or a curved surface.

The third object indicated above may be achieved according to a fourth aspect of the present invention, which provides an end-contact type thermal recording head comprising: a ceramic substrate having a thin-walled end portion; an electrically resistive heat-generating portion provided on the thin-walled end portion of the substrate; recording and return-circuit electrodes electrically connected to the heat-generating portion to energize the heat-generating portion; and a heat radiating member disposed such that a portion of the heat radiating member is adjacent to the electrically resistive heat-generating portion. The ceramic substrate is made of a material having a thermal conductivity which is lower than that a material of the heat radiating member and which falls within a range between 0.002 cal.cm/sec.cm$^2$.°C. and 0.03 cal.cm/sec.cm$^2$.°C.

The thermal conductivity of the material of the ceramic substrate is preferably held within a range between 0.002 cal.cm/sec.cm$^2$.°C. and 0.01 cal.cm/sec.cm$^2$.°C. The heat radiating member may be made of a material having a thermal conductivity which is higher than that of the material of the ceramic substrate and which is higher than 0.01 cal.cm/sec.cm$^2$.°C.

The third object may also be achieved according to a fifth aspect of the present invention, which provides an end-contact type thermal recording head comprising: a ceramic substrate having a thin-walled end portion; an electrically resistive heat-generating portion provided on the thin-walled end portion of the substrate; recording and return-circuit electrodes electrically connected to the heat-generating portion to energize the heat-generating portion; and a heat radiating member disposed such that a portion of the heat radiating member is adjacent to the electrically resistive heat-generating portion. The heat radiating member is made of a material having a thermal conductivity which is higher than that of a material of the ceramic substrate and which is higher than 0.01 cal.cm/sec.cm$^2$.°C.

For effectively utilizing the heat generated by the electrically resistive heat-generating portion, for thermally recording images, it is necessary to accurately control the thermal characteristic or heat accumulating characteristic of the end portion of the substrate on which the heat-generating portion is provided. In a known thermal recording head using a substrate made of alumina or metal having a comparatively high thermal conductivity, the heat accumulating ability of the head is low, and the heat generated by the heat-generating portion tends to be dissipated without being effectively utilized for thermal recording of images. In the known thermal recording head shown in FIG. 38, the glaze layer 106 of a glass material is formed on the substrate 102 for increasing the heat accumulating ability of the substrate. However, the formation of the glaze layer 106 increases the cost of manufacture of the recording head, and reduces the freedom of design in respect of the thermal characteristic of the head, because of the limitations in the material, configuration and formation process of the glaze layer 106. While a thermal recording head using a cylindrical glass rod as a substrate is known, this type of recording head suffers from deterioration of the quality of recorded images, due to an excessively high heat accumulating ability of the glass rod.

The above problem may be solved by using a ceramic substrate made of a material having a thermal conductivity which is lower than a relatively high thermal conductivity of alumina or metal and which is higher than a relatively low thermal conductivity of a glass material. The use of the substrate whose thermal conductivity is determined as described above according to the fourth aspect of the invention makes it possible to eliminate the conventionally required glaze layer, thereby lowering the cost of manufacture of the recording head.

Further, the use of the ceramic substrate whose thermal conductivity is determined as described above makes it possible to control the heat accumulating ability of the thin-walled end end portion of the recording head, by suitably determining the shape and volume of the substrate. Thus, the instant recording head has an improved degree of freedom of design in respect of the thermal characteristics.

The provision of the heat radiating member adjacent to the heat-generating portion formed on the thin-walled end portion of the substrate according to the fourth and fifth aspects of the invention permits the heat generated by the heat-generating portion to be efficiently dissipated, after the generated heater is effectively utilized for thermal recording. Namely, the heat radiating member made of a material having a thermal conductivity which is higher than that of a material of the ceramic substrate and which is higher than 0.01 cal.cm/sec.cm$^2$.°C. functions to prevent blurring, blotting or expansion of recorded image dots, and distortion of the images due to prolonged heat application from the heat-generating portion to the recording medium or thermally imaging intermediate medium. The present recording head exhibits improved heat radiating characteristic, particular where the recording operation is effected at a high speed.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
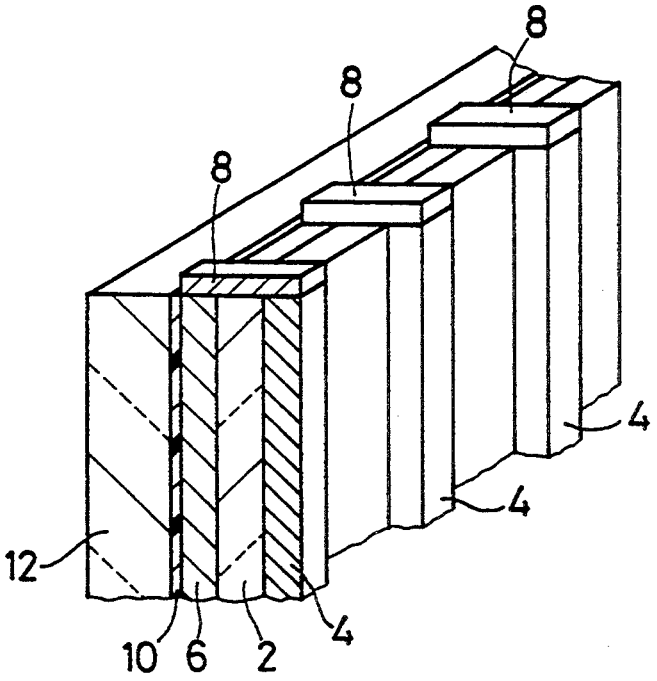
FIG. 1 is a fragmentary perspective view showing one embodiment of an end-contact type thermal recording head of the present invention.
Figure 2:
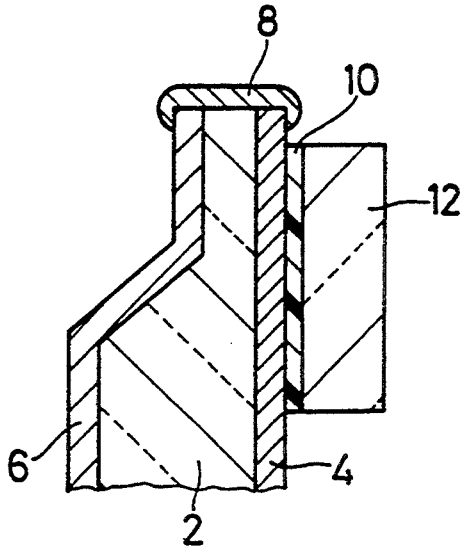
FIG. 2 is a fragmentary cross sectional view in elevation of another embodiment of the invention.
Figure 3:
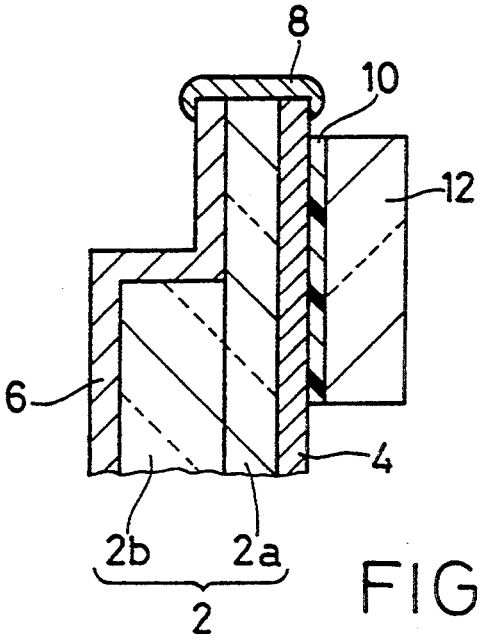
FIG. 3 is a fragmentary cross sectional view showing an example of an end-contact type thermal recording head using a laminated type substrate according to a further embodiment of the invention.

Referring first to FIGS. 1–3, there are illustrated three different embodiments of the present invention, wherein a multiplicity of recording electrodes 4 in the form of parallel spaced-apart strips are formed on one of opposite major surfaces of a ceramic substrate 2, such that the recording electrodes 4 are spaced apart from each other in a direction parallel to the major surfaces and perpendicular to an end face of the substrate 2. On the other major surface of the substrate 2, there is disposed a common return-circuit electrode 6 in the form of a sheet having a shape similar to that of the substrate 2. On the end face indicated above the substrate 2, there is formed an electrically resistive heat-generating portion 8 consisting of a multiplicity of electrically resistive films which electrically connects the respective recording electrode strips 4 to the common return-circuit electrode sheet 6. Each electrically resistive film 8 has a length sufficient to cover at least the thickness of the ceramic substrate 2, and a suitable thickness as measured from the end face of the substrate 2. Reference numeral 8 will be used to denote both the heat-generating portion, and the electrically resistive films which constitute the heat-generating portion.

The thermal recording heads shown in FIGS. 1–3 all have a reinforcing member 12 having a suitable thickness. In the recording head of FIG. 1, the reinforcing member 12 is bonded to the common return-circuit electrode 6 by an adhesive layer 10. In the recording heads of FIGS. 2 and 3, the reinforcing member 12 is bonded by the adhesive layer 10 to the major surface of the substrate 2 on which the recording electrode strips 4 are formed. In each recording head of FIGS. 1–3, the reinforcing member 12 is provided at least near or adjacent to the end portion of the substrate 2. Thus, the recording head has an integral laminar structure.

As shown in FIGS. 1–3, the ceramic substrate 2 of the end-contact type thermal recording heads is thin-walled at least at the end portion at which the heat-generating portion 8 (electrically resistive films) is provided. In the embodiment of FIG. 1, the substrate 2 has a relatively small, constant thickness. In the embodiment of FIG. 2, the thin-walled end portion is formed by a press forming technique or by cutting or machining the blank for the substrate, to remove some stock from the blank for thereby reducing the thickness over a predetermined length as measured from the end face on which the heat-generating portion 8 is formed. In the embodiment of FIG. 3, a thin fired or green ceramic sheet 2*a* and a comparatively thick fired or green ceramic sheet 2*b* are laminated or bonded together and heat-treated as needed for integration, so that the thin-walled end portion of the ceramic substrate is provided by the thin ceramic sheet 2*a*. In the thermal recording head of FIG. 2, the ceramic substrate 2 is formed with a shoulder surface between the thin-walled end portion and the thick-walled proximal portion. While this shoulder surface is a flat inclined surface which forms an obtuse angle to the adjacent surfaces of the thin-walled and thick-walled portions of the substrate 2, the shoulder surface may be at right angles to the adjacent surfaces or a curved surface.

The thickness of the thin-walled end portion of the ceramic substrate 2 is suitably selected depending upon the required recording or thermal imaging characteristics of the recording head. According to the present aspect of the invention, the thickness of the thin-walled end portion is preferably selected within a range of about 10–90 μm, more preferably within a range of about 20–70 μm. If the thickness of the thin-walled end portion is smaller than 10 μm, the length of the electrically resistive films 8 as measured in the direction of thickness of the substrate 2 is insufficient for assuring high quality of images (formed by dots) recorded by the head. If the thickness is larger than 90 μm, the length of the films 8 is too large to permit high density of dots to be formed by the head, i.e., high resolution of images reproduced. For this reason, it is desired that the thickness of the thin-walled end portion of the substrate 2 be within the range specified above.

The ceramic substrate 2 is preferably made of glass ceramic material, alumina, aluminum nitride, zirconia, or highly machinable or free-cutting glass ceramic material. In particular, a free-cutting glass ceramic material including mica is desirable, because of its suitable degree of heat accumulating property.

The recording electrodes 4 and the common return-circuit electrode 6 which are formed on the opposite major surfaces of the ceramic substrate 2 are provided to energize the electrically resistive films 8, which in operation of the recording head are held in contact with a suitable recording medium such as a heat-sensitive paper or a thermally imaging intermediate medium such as a ribbon or film interposed between the recording head and the recording medium. It will be understood that the distance between the recording and return-circuit electrodes 4, 6 is determined by the thickness of the thin-walled end portion of the substrate 2. Since the end portion of the substrate 2 is thin-walled as described above, the electrically resistive films of the heat-generating portion 8 can be effectively contacted with the heat-sensitive paper or thermally imaging intermediate medium, for efficiently concentrating the heat generated by the films 8 on the respective recording spots on the recording medium or intermediate medium. Thus, the heat-generating response of the recording head can be considerably improved for high-quality printing or imaging on the recording medium.

The recording and return-circuit electrodes 4, 6 formed on the opposite major surfaces of the substrate 2 are generally made of an electrically conductive material, usually, an electrically conductive material whose wear resistance is higher than that of the substrate 2. It is preferable to select the electrically conductive material for the electrodes 4, 6, from among: metals such as chromium, titanium, molybdenum, tungsten, nickel, gold and copper; and alloy, nitride, carbide and boride which includes one or more of the metals indicated above. The electrodes 4, 6 are formed of the selected material, by an ordinary thin-film or thick-film forming technique or other suitable techniques, on the respective major surfaces of the substrate 2. The recording electrodes 4 in the form of strips are formed to a suitable pattern depending upon the desired recording density, i.e., dot-to-dot spacing, while the common return-circuit electrode 6 is formed as a sheet on the substrate 2 by a suitable technique, or by bonding a suitably shaped Sheet to the substrate 2. However, the common return-circuit electrode 6 may be replaced by multiple return-circuit electrodes 6 corresponding to the recording electrodes 4. The thickness of the electrodes 4, 6 is selected to be at least 0.5 μm, preferably at least 1 μm, more preferably at least 3 μm. The electrodes 4, 6 may have two or more layers formed of the same material or respective different materials selected from among the electrically conductive materials indicated above.

The electrically resistive films 8 of the heat-generating portion formed on the end face of the thin-walled end portion of the substrate 2 are films formed by a thin-film or thick-film forming method, preferably of a highly electrically resistive material which exhibits excellent pulse characteristics at an elevated temperature. Generally, the material for the electrically resistive films 8 is selected from the group consisting of: a composition principally consisting of a metal having a high melting point, or an alloy of such high-melting-point metal; a composition principally consisting of a mixture of such high-melting-point metal or alloy and an oxide, nitride, boride or carbide; a composition principally consisting of a nitride, carbide, boride or silicide of at least one element selected from the group consisting of titanium, tantalum, chromium, zirconium, hafnium, vanadium, lanthanum, molybdenum and tungsten; and a composition principally consisting of an oxide of ruthenium. The electrically resistive films 8 are formed by an ordinary thin-film or thick-film forming technique, to a suitable pattern depending upon the desired recording density. However, these separate films 8 may be replaced by a single continuous strip covering the entire end face of the substrate. The films 8 are formed so as to cover at least the entire thickness of the end face of the thin-walled end portion of the substrate 2.

While the electrically resistive films 8 are formed so as to cover at least the respective portions of the end face of the substrate 2, the films 8 may cover the end portions of the electrodes 4, 6, as shown in FIGS. 1–3, so that the films 8 connect the recording and return-circuit electrodes 4, 6. In this case, the films 8 are formed after the electrodes 4, 6 are formed on the respective major surfaces of the substrate 2. Alternatively, the films 8 are formed before the electrodes 4, 6 are formed, such that the films 8 cover only the respective portions of the end face of the substrate 2 while the end portions of the electrodes 4, 6 cover the end portions of the films 8. Either of these two alternative arrangements may be adopted, provided that the electrically resistive films 8 connect the recording and return-circuit electrodes 4, 6.

Since the end portion of the thermal recording head on which the heat-generating portion consisting of the electrically resistive films 8 is formed is thin-walled as described above, the reinforcing member 12 is provided on at least one side of the substrate 2, so as to reinforce at least the thin-walled end portion of the head. The reinforcing member 12 is bonded by the adhesive layer 10 to the return-circuit electrode 6 or to the major surface of the substrate 2 on which the recording electrodes 4 are formed. Preferably, the reinforcing member 12 is made of a material whose hardness is lower than those of the electrodes 4, 6 and whose wear resistance is lower than that of the electrically resistive films 8. Where a protective layer 24 is provided as indicated at 24 in FIGS. 9–11, the wear resistance of the material for the reinforcing member 12 is preferably lower than that of the protective layer 24. It is particularly desirable to use a metal, ceramic, glass or glass ceramic material whose knoop hardness is not higher than 1000 kgf/mm$^2$, preferably, not higher than 500 kgf/mm$^2$. The relatively low wear resistance of the reinforcing member 12 assures the electrically resistive films 8 to project a suitable small distance endwise of the substrate 2, from the reinforcing member 12, so that the films 8 are held in sliding contact with the heat-sensitive paper or thermally imaging intermediate ribbon or film. Thus, the reinforcing member 12 reinforces the recording head to give the head a sufficiently large mechanical strength, while allowing good contact of the films 8 with the recording medium or thermally imaging intermediate medium.

The reinforcing member 12 is preferably made of a easily-worn material having at least one major component selected from among highly machinable or free-cutting glass ceramic material, free-cutting glass ceramic material containing mica, free-cutting alumina, free-cutting boron nitride, free-cutting aluminum nitride, brass, copper, aluminum and bronze. For improved characteristic of sliding contact of the recording head, the reinforcing member 12 is principally made of free-cutting glass ceramic containing mica, free-cutting alumina, free-cutting boron nitride or free-cutting aluminum nitride. It is noted that the reinforcing member 12 principally made of free-cutting alumina, free-cutting boron nitride or free-cutting alumina nitride has considerably high thermal conductivity, permitting the heat generated by the electrically resistive films 8 to be effectively radiated.

The thermal recording head having the reinforcing member 12 located to cover at least the thin-walled end portion has increased mechanical strength at its end portion, and is thus protected from separation or flake off of the electrically resistive films 8 (and the protective layer 24), which may occur due to the sliding contact of the films 8 (or protective layer 24) with the heat-sensitive recording medium or thermally imaging intermediate medium. Accordingly, the present recording head is free from deterioration of the quality of the recorded images, which would otherwise arise from the material separated from the films 8 and inserted between the heat-generating portion and the recording medium or intermediate medium. Thus, the present recording head has a structural advantage over the known end-contact type thermal recording head.

The adhesive layer 10 for bonding the reinforcing member 12 to the substrate 2 or the common return-circuit electrode 6 may consist of an inorganic material containing alumina, silica or boron nitride, or a resinous material containing epoxy resin, phenol or polyimide. The adhesive layer 10 may be a mixture of such inorganic and resinous materials. However, it is desirable to use an inorganic material containing alumina, silica or boron nitride.

Figure 4:
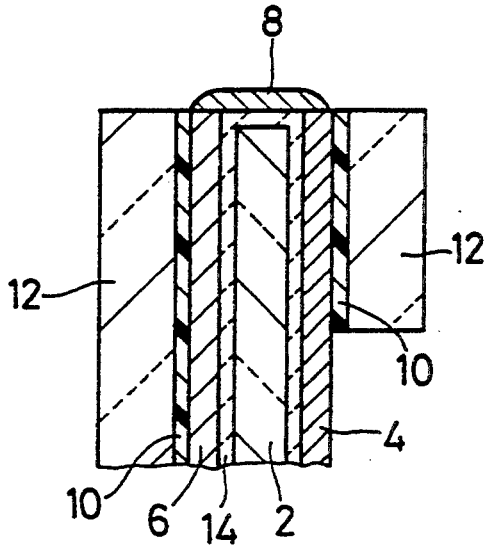
FIG. 4 is a fragmentary cross sectional view of a still further embodiment of the invention wherein two reinforcing members are provided on opposite sides of a substrate corresponding to opposite major surfaces of the substrate.

Referring to FIG. 4, there is shown a thermal recording head according to a further embodiment of this invention, in which two reinforcing members 12 are provided on the opposite sides of the substrate 2. The reinforcing member 12 formed on the surface of the substrate 2 on which the recording electrodes 4 are provided covers only the end portion of the substrate 2 adjacent to the heat-generating portion 8. Further, a glaze layer 14 made of a glass material or other electrically insulating material is formed so as to cover the end face and the opposite major surfaces of the substrate 2, so that the recording and return-circuit electrodes 4, 6 are formed on the glaze layer 14. The glaze layer 14 functions not only to lower the heat transfer speed of the electrically resistive films 8, but also to increase the bonding strength between the films 8 and the substrate 2.

Various other modified embodiments of the present invention are illustrated in FIG. 5 through FIG. 11.

Figure 5:
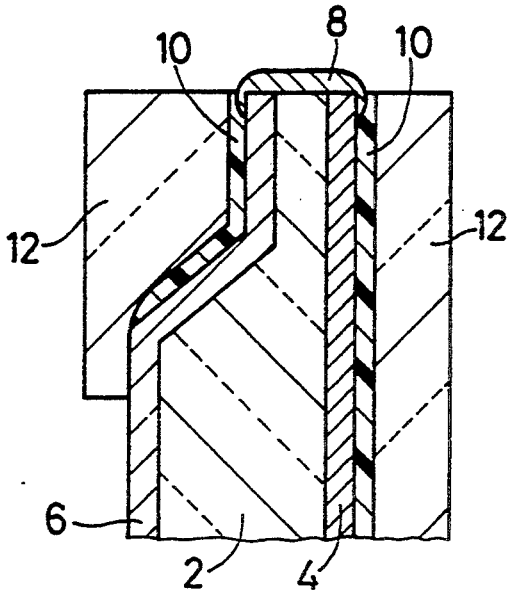
FIG. 5 is a fragmentary cross sectional view showing a modified form of the recording head of FIG. 4.

In the embodiment of FIG. 5, two reinforcing members 12 are bonded by the respective adhesive layers 10 to the return-circuit electrode 6 formed on one major surface of the substrate 2, and to the major surface of the substrate 2 on which the recording electrodes 4 are formed. The reinforcing members 12 are formed after the electrically resistive films 8 are formed to cover the end face of the substrate 2. The reinforcing member 12 on the return-circuit electrode 6 covers only the end portion of the substrate 2 which has an inclined shoulder surface.

Figure 6:
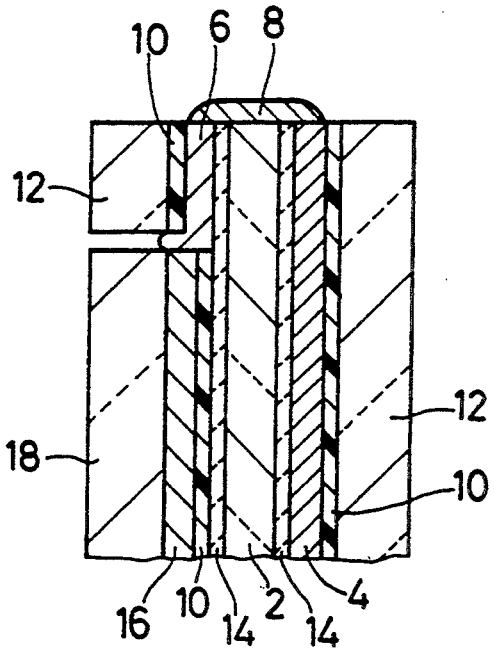
FIG. 6 is a fragmentary cross sectional view of another embodiment of this invention.

The embodiment of FIG. 6 has the glaze layer 14 described above with respect to the embodiment of FIG. 4. In this recording head, a first reinforcing member 12 is formed so as to cover the recording electrodes 4 on one major surface of the substrate 2, while a second reinforcing member 12 is formed so as to cover the return-circuit electrode 6 which is provided to cover only the end portion of the other major surface of the substrate 2. A mounting base member 18 having an electrical lead member 16 is bonded by an adhesive layer 10 to a portion of the glaze layer 14 on the side of the substrate 2 on which the return-circuit electrode 6 is provided. The electrical lead member 16 is electrically connected to the return-circuit electrode 6.

Figure 7:
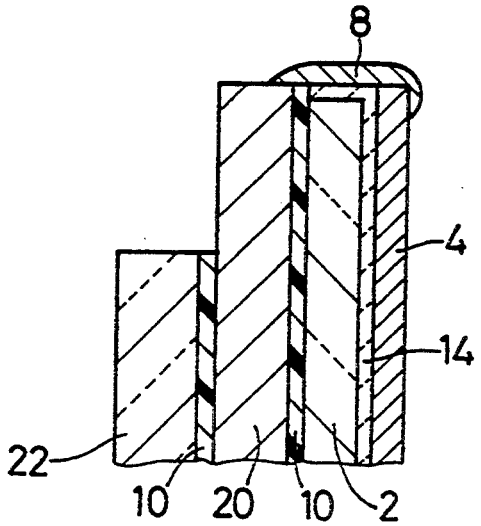
FIG. 7 is a fragmentary cross sectional view of a yet another embodiment of the invention, which has a return-circuit electrode in the form of a sheet.
Figure 8:
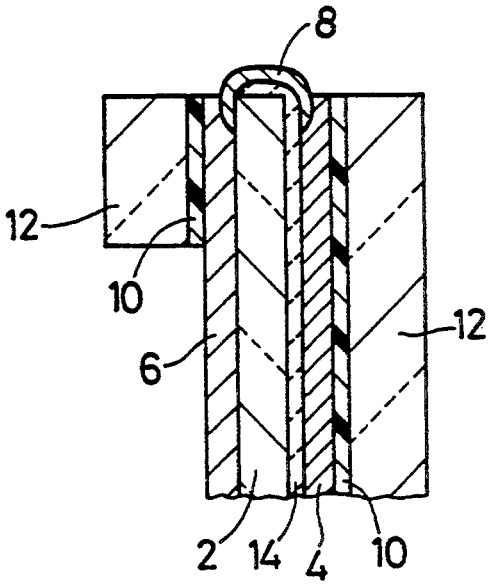
FIGS. 8–11 are fragmentary cross sectional view of further embodiments of the end-contact type thermal recording head of the invention.

In the thermal recording head of FIG. 7, the recording electrodes 4 are formed on the glaze layer 14 formed on one of opposite major surfaces of the ceramic substrate 2, while a common return-circuit electrode sheet 20 is bonded to the other major surface of the substrate 2 by the adhesive layer 10. The return-circuit electrode sheet 20 also functions as a reinforcing member and is partly covered by an electrically insulating layer 22 bonded thereto via another adhesive layer 10. In the embodiment of FIG. 8, the glaze layer 14 is first formed on one major surface of the substrate 2, and the electrically resistive films 8 are then formed so as to cover the end face of the substrate 2. Subsequently, the recording and return-circuit electrodes 4, 6 are formed on the respective opposite major surfaces of the substrate 2. The two reinforcing members 12, 10 12 are provided in contact with the recording and return-circuit electrodes 4, 6, in the same fashion as in the embodiment of FIG. 6.

Figure 9:
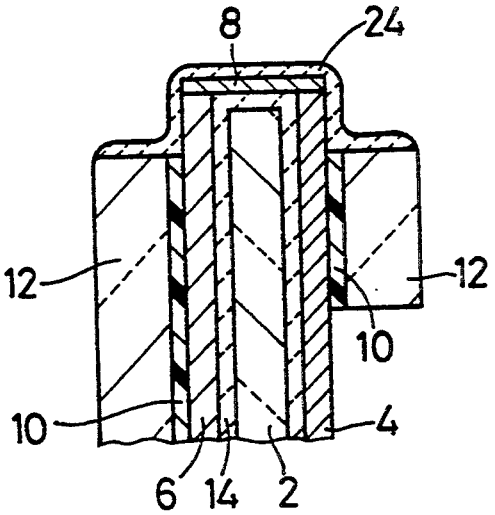
Figure 10:
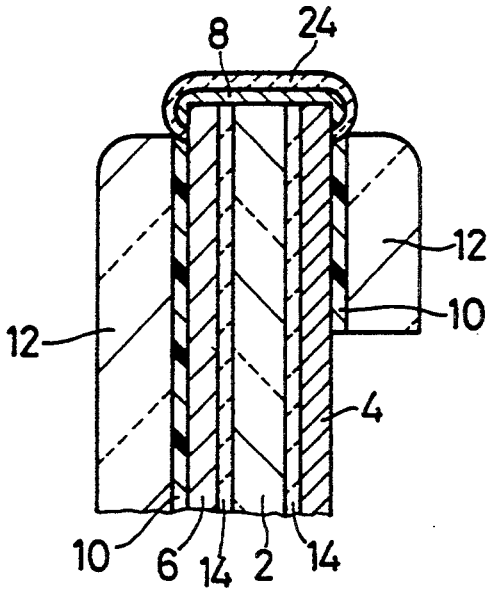
Figure 11:
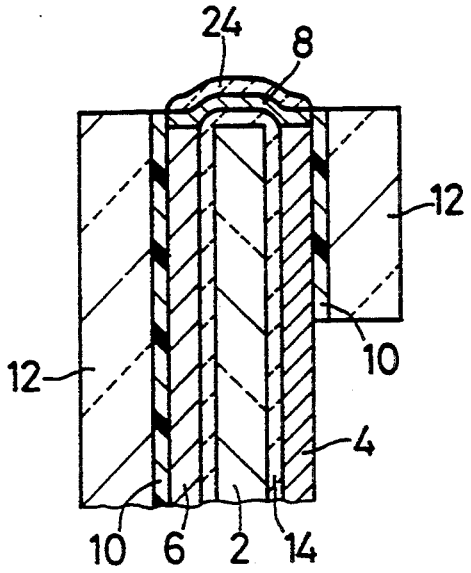

In the thermal recording heads of FIGS. 9–11, two reinforcing layers 12, 12 are formed in contact with the recording and return-circuit electrodes 4, 6. Further, a protective layer 24 is provided so as to cover at least the electrically resistive films 8, for protecting the films 8 and the electrodes 4, 6. This protective layer 24 is made of an electrically insulating material such as silicon oxides, silicon nitrides, silicon carbides, tantalum oxides and glass materials. The protective layer 24 effectively protects the films 8 and end portions of the electrodes 4, 6 against oxidation and wear and also functions as an electric insulator. The protective layer 24 is formed by a known method such as sputtering, CVD and thick-film forming technique. The layer 24 may be a single layer of a selected insulating material indicated above, or a laminar structure consisting of two or more layers of different insulating materials. Where the protective layer 24 is used to insulate electrically an electrical lead member as indicated at 16 in FIG. 6, the layer 24 is desirably made of an organic material such as epoxy, phenol or polyimide.

In the embodiment of FIG. 9, the electrodes 4, 6 are formed on the glaze layer 14 formed on the opposite major surfaces of the substrate 2. The protective layer 24 is formed so as to cover the electrically resistive films 8, end portions of the electrodes 4, 6 and the corresponding end faces of the reinforcing members 12. In the embodiment of FIG. 10, the protective layer 24 covers the films 8, which cover the end faces of the substrate 2, glaze layer 14 and electrodes 4, 6, and the adjacent end portions of the side surfaces of the electrodes 4, 6. In the embodiment of FIG. 11, the glaze layer 14 covers the end face of the substrate 2, and the films 8 Cover the end faces of the electrodes 4, 6, and the portion of the glaze layer 14 covering the end face of the substrate 2. The protective layer 24 covers only the films 8.

Referring next to FIGS. 12–17, there will be described end-contact type thermal recording heads which have a heat radiating member 26 in place of the reinforcing member 12 provided in the preceding embodiments. Like the reinforcing member 12, each heat radiating member 26 is disposed such that one end of the member 26 is located near or adjacent to the heat-generating portion 8 (electrically resistive members 8) formed on the end face of the substrate 2.

In the embodiments of FIGS. 12–17, the thickness of the substrate 2 as measured at the end face on which the heat-generating portion 8 is formed is selected within a range of about 10–400 μm, preferably within a range of about 0–100 μm. If the thickness is smaller than 10 μm, the length of the electrically resistive films 8 as measured in the direction of thickness of the substrate 2 is insufficient for assuring high quality of images recorded by the head. If the thickness is larger than 400 μm, the end of the electrically resistive films 8 remote from the heat radiating member 26 is so distant from the heat radiating member 26 that the heat generated by the resistive films 8 tends to be accumulated in the end portion of the recording head. For achieving the intended recording result, the thickness of the substrate 2 as measured at the end face should be held within the range specified above.

Figure 12:
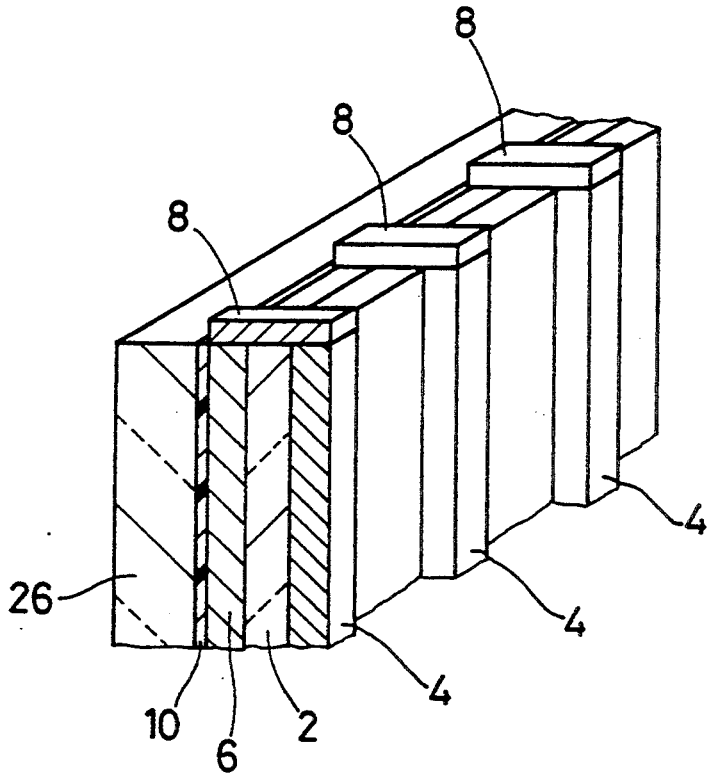
FIG. 12 is a fragmentary perspective view showing a yet further embodiment of the present invention which has a heat radiating member.

The thermal recording heads of FIG. 12 is structurally identical with the head of FIG. 1, except for the heat radiating member 26. The recording head of FIG. 13 uses the substrate 2 having the same thin-walled end portion as shown in FIG. 2. In this embodiment of FIG. 13, the heat radiating member 26 is bonded to the return-circuit electrode 6 by the adhesive layer 10. In the embodiment of FIG. 14, the substrate 2 has a thin-walled end portion having a flat inclined surface, which terminates in the end face of the substrate, contrary to the inclined shoulder surface of the substrate 2 of FIG. 13. In the embodiment of FIG. 14, the electrically resistive films 8 are formed before the electrodes 4, 6 are formed on the substrate 2.

Figure 15:
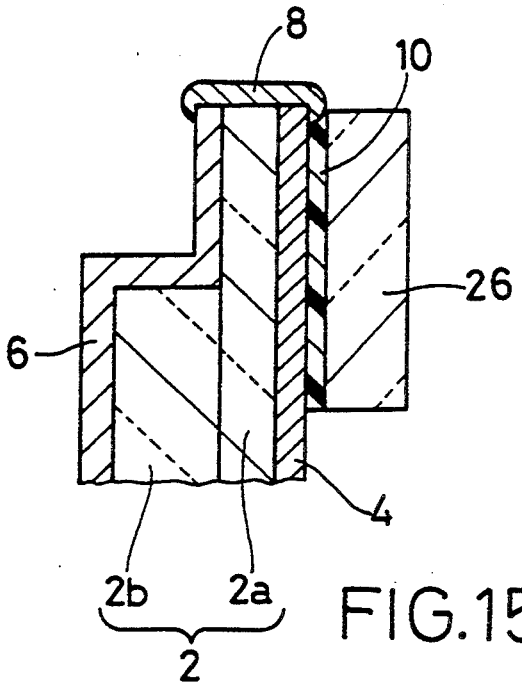
Figure 16:
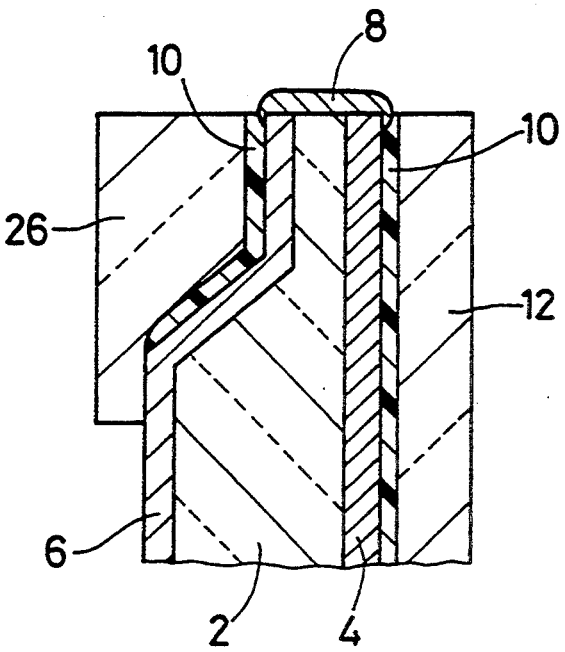
Figure 17:
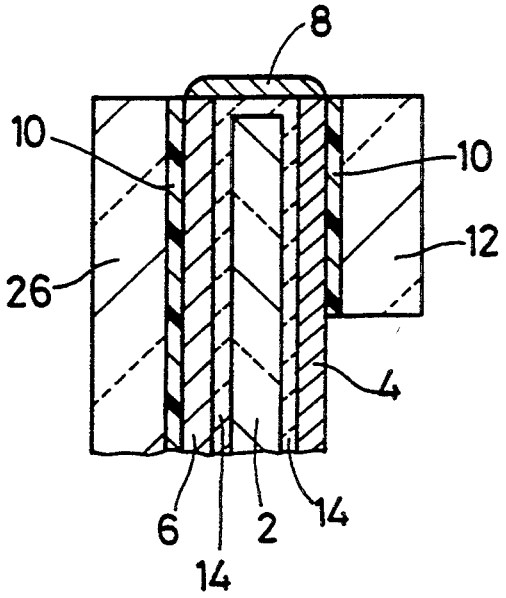

The recording heads of FIGS. 15–17 are structurally identical with the heads of FIG. 3, FIG. 5 and FIG. 4, respectively, except for the heat radiating member 26. In the embodiments of FIGS. 16 and 17, the heat radiating member 26 is disposed in contact with the return-circuit electrode 6, while the reinforcing member 12 is disposed in contact with the recording electrodes 4. The reinforcing member 12 is provided for the same purpose as described above and is made of the material described above.

The ceramic substrate 2 used in the embodiments of FIGS. 12–17 is made of a suitable material such as a glass material, a glass ceramic material, highly machinable or free-cutting ceramic material and zirconia, preferably free-cutting glass ceramic material containing mica. Namely, the substrate 2 is required to exhibit a suitable degree of heat accumulating property in order to concentrate the generated heat on the desired local spots on the recording medium or thermally imaging intermediate medium. In this respect, the substrate 2 is preferably formed of a free-cutting glass ceramic material containing mica, since its heat accumulating ability is higher than those of alumina and aluminum nitride, and is lower than that of a glass material.

Figure 13:
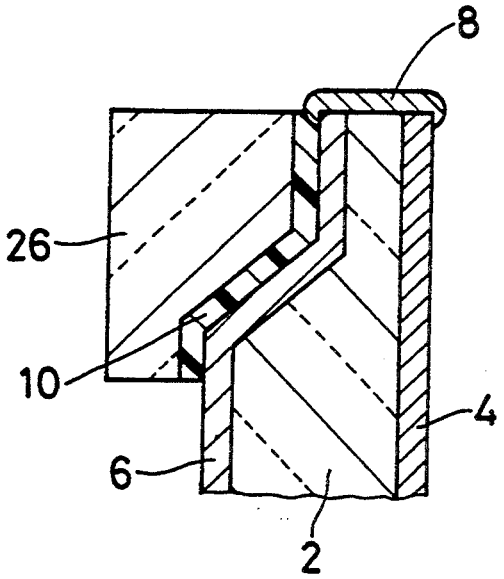
FIGS. 13–17 are fragmentary cross sectional views showing modifications of the embodiment of FIG. 12.
Figure 14:
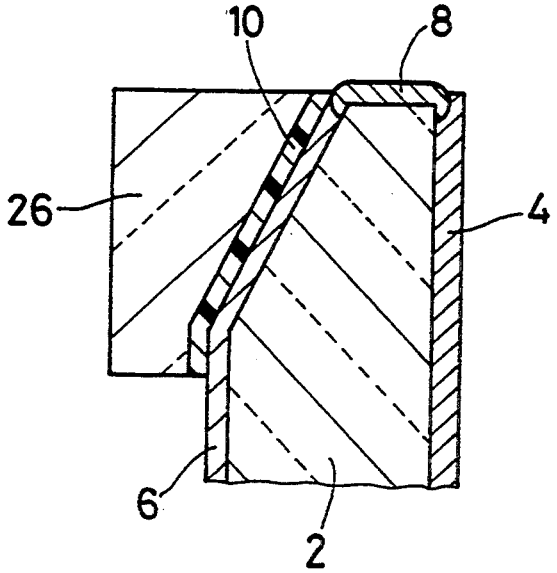

The use of the free-cutting glass ceramic containing mica is also desirable where the substrate 2 is mechanically cut or machined to form the thin-walled end portion, as in the embodiments of FIGS. 13 and 14. The free-cutting glass ceramic containing mica can be easily cut with high precision, whereby the thin-walled end portion can be shaped and dimensioned as desired.

Further, the use of a free-cutting glass ceramic material which has a suitable heat accumulating ability eliminates a glaze layer conventionally interposed between the substrate and the heat-generating portion 8 (electrically resistive films), thereby lowering the cost of manufacture of the recording head, and avoiding shortening of the life expectancy of the heat-generating portion 8 due to a reaction of the heat-generating portion and the glaze layer.

The heat radiating member 26 located so as to be adjacent to the heat-generating portion 8 formed on the end face of the substrate 2 functions to radiate effectively the heat generated by the heat-generating portion 8, whereby the recording head is capable of performing a recording operation, without blurring, blotting or expansion of image dots and distortion of the recorded images due to prolonged heat application from the electrically resistive films of the heat-generating portion 8 to the recording medium or thermally imaging intermediate medium such as a thermally fusible ink ribbon.

The heat radiating member 26 is preferably made of a material which consists principally of a highly machinable or free-cutting alumina, free-cutting machinable boron nitride, free-cutting aluminum nitride, brass, copper, aluminum, bronze, or a mixture of these materials. For good sliding contact of the recording head, it is desirable that the heat radiating member 26 consists principally of free-cutting alumina, or free-cutting boron nitride or aluminum nitride. For improved heat radiation, the heat radiating member 26 is preferably disposed so that its end adjacent to the heat-generating portion 8 can directly contact the heat-sensitive paper (recording medium) or the thermally imaging intermediate medium such as an ink ribbon or film. That is, it is desirable that the end face of the heat radiating member 26 be almost flush with the contact surfaces of the electrically resistive films 8.

Figure 18:
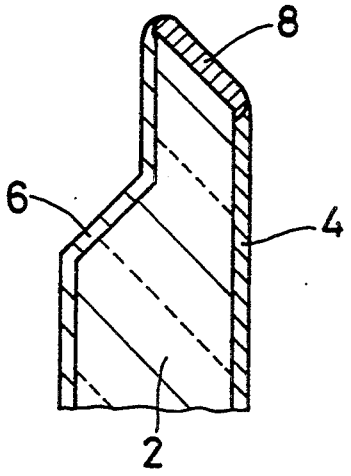
FIGS. 18–19 are fragmentary cross sectional views showing ceramic substrates of the present invention whose end faces are not perpendicular to the opposite major surfaces.
Figure 19:
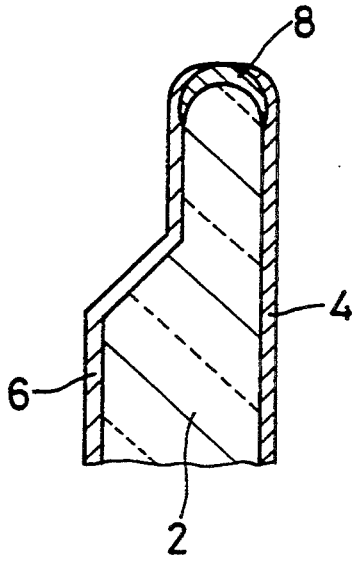
Figure 20:
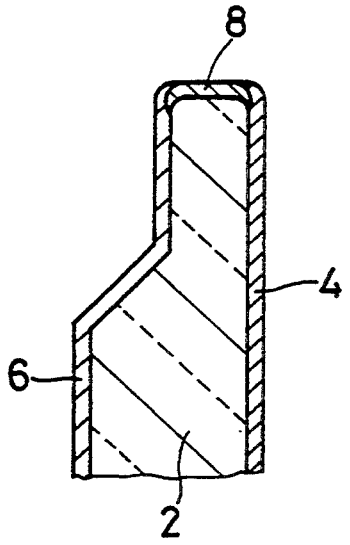
FIG. 20 is a fragmentary cross sectional view showing the ceramic substrate of the present invention whose end face is rounded at its ends.
Figure 21:
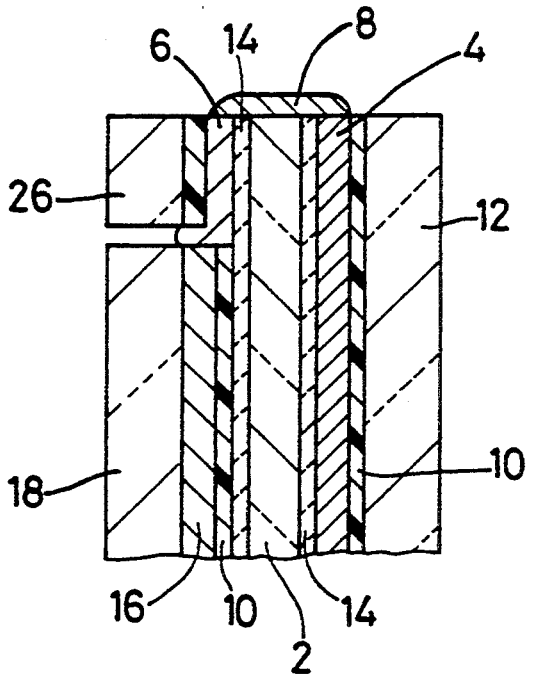
FIGS. 21–26 are fragmentary cross sectional views of still further embodiments of the invention which have a heat radiating member.

The end face of the substrate 2 on which the heat-generating portion 8 is formed need not be perpendicular to the opposite major surfaces of the substrate on which the recording and return-circuit electrodes 4, 6 are formed, as in the embodiments of FIGS. 12–17. Namely, the end face of the substrate 2 may be inclined relative to the major surfaces, as shown in FIG. 18, or may be rounded or arcuately curved surface contiguous to the major surfaces, as shown in FIG. 19. Further, the end face of the substrate 2 may be chamferred or rounded at the edges adjacent to the major surfaces, as shown in FIG. 20.

Referring to FIGS. 21–26, there are shown modified forms of the recording head having the heat radiating member 26, which are structurally identical with the embodiments of FIGS. 6–11, except for the heat radiating member 26 provided in place of the reinforcing member 12.

Figure 22:
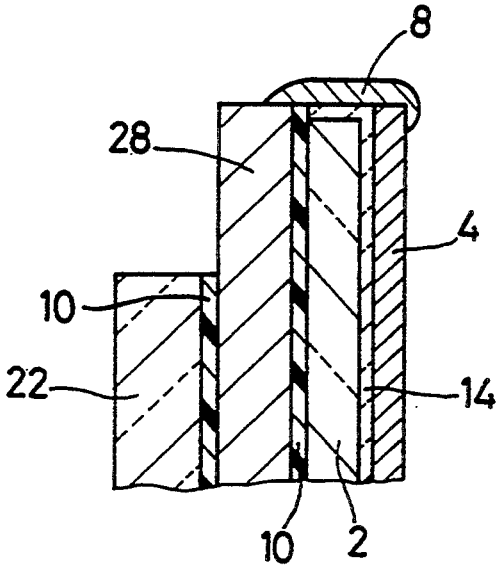
Figure 23:
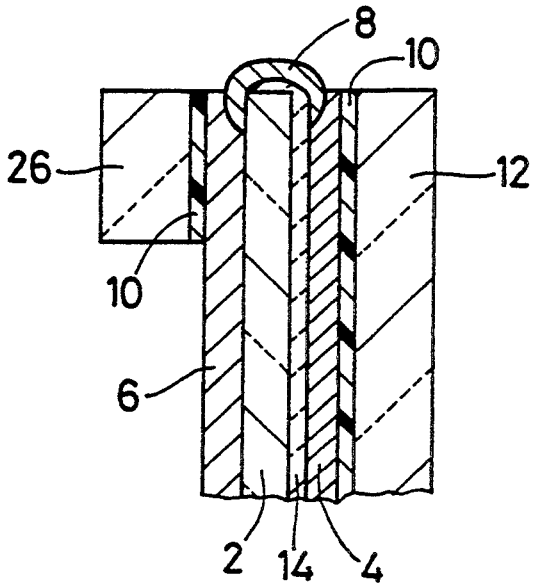
Figure 24:
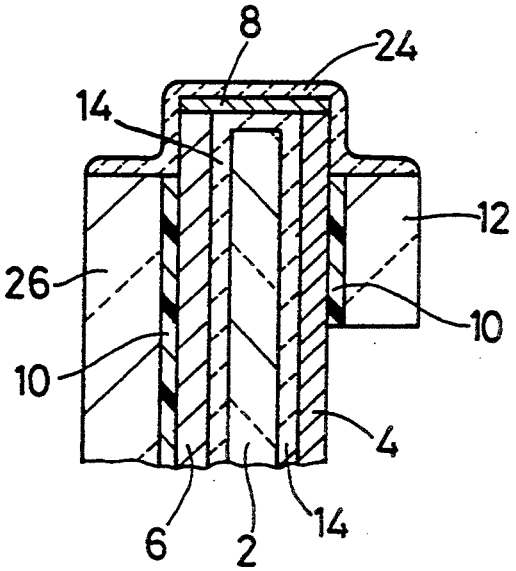
Figure 25:
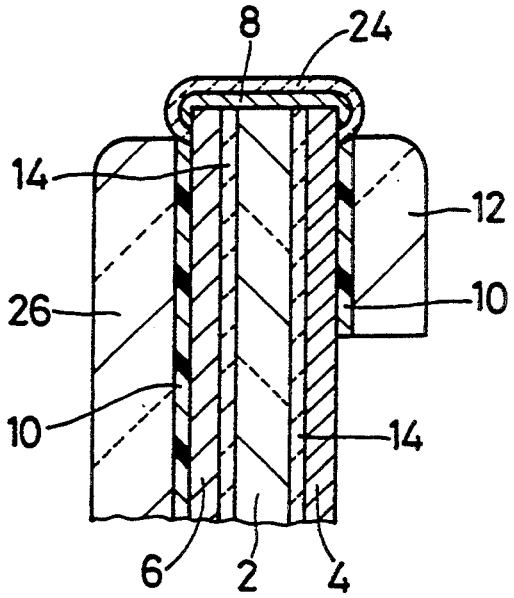
Figure 26:
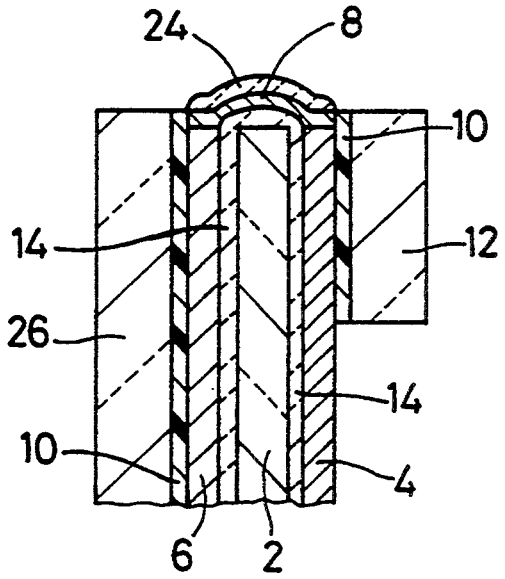

In the embodiments of FIGS. 21 and 23–26, the heat radiating member 26 is bonded by the adhesive layer 10 to the common return-circuit electrode sheet 6 on one side of the substrate 2, while the reinforcing member 12 is disposed in contact with the recording electrodes 4 on the other side of the substrate 2. In the embodiment of FIG. 22, a common return-circuit electrode sheet 28 also serves as a heat radiating member similar to the member 26.

Figure 27:
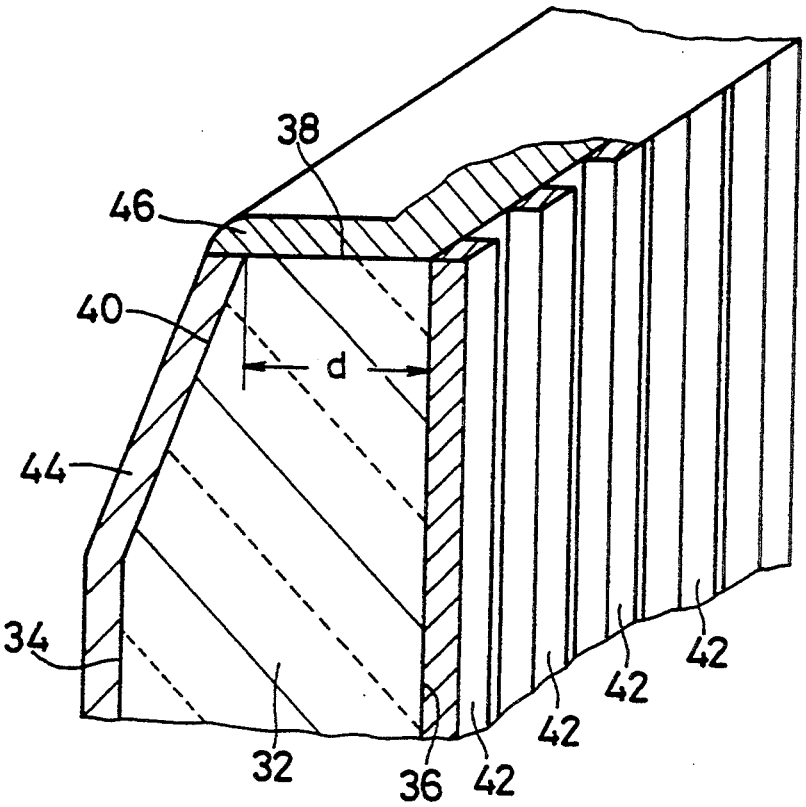
FIG. 27 is a fragmentary perspective view showing another embodiment of the present invention wherein the substrate has a shoulder surface which terminates in the end face.
Figure 28:
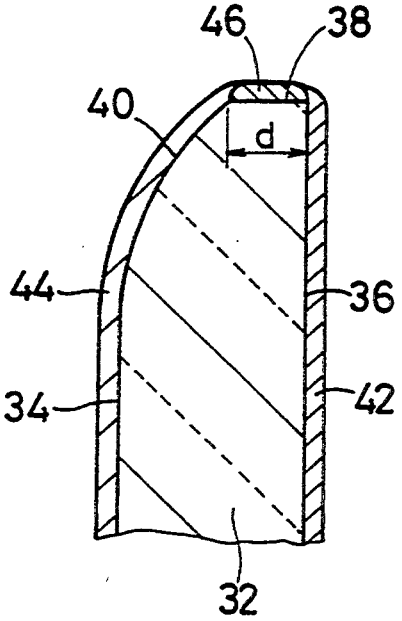
FIGS. 28–31 are fragmentary cross sectional views showing modifications of the embodiment of FIG. 27.
Figure 29:
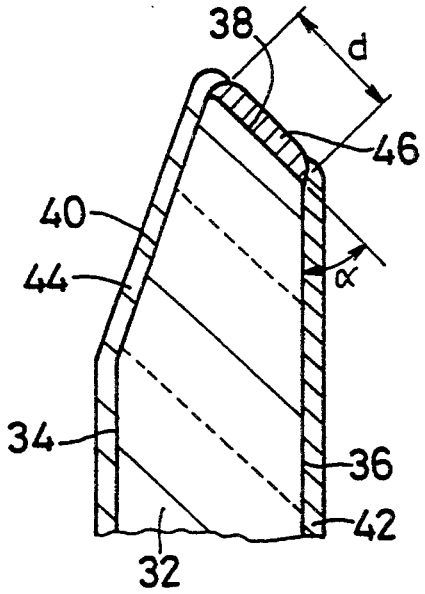
Figure 30:
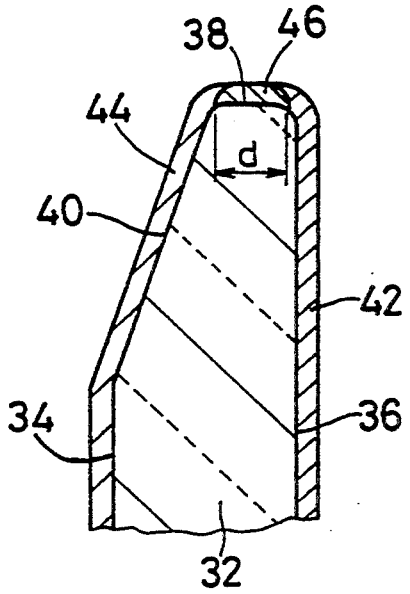

Reference is now made to FIGS. 27–31, which show different forms of a still further embodiment of the present invention. In these figures, reference numeral 32 denotes a ceramic substrate which has opposite flat major surfaces 34, 36 parallel to each other, an end face 38, and a shoulder surface 40 which extends from the first major surface 34 and terminates in the end face 38 such that the shoulder surface 40 progressively approaches the second major surface 36 as it extends from the first major surface 34. The shoulder surface 40 is a flat or curved surface. In the presence of the shoulder surface 40, the ceramic substrate 32 has a thin-walled distal end portion having the end face 38. On the second major surface 34 of the substrate 32, there are formed a multiplicity of recording electrodes 42 in the form of spaced-apart parallel strips, as shown in FIG. 27. On the other hand, a common return-circuit electrode 44 in the form of a sheet is formed on the first major surface 34 and the shoulder surface 40. These recording and return-circuit electrodes 42, 44 are electrically connected at their ends to a heat-generating portion in the form of an electrically resistive heat-generating layer 46 formed so as to cover the end face 38 of the thin-walled end portion of the substrate 32. 10 In the end-contact type thermal recording head of FIG. 27, the shoulder surface 40 is a flat surface connecting the first major surface 34 and the flat end face 38 on which the heat-generating layer 46 is formed. In the recording head of FIG. 28, the shoulder surface 40 is a rounded or curved surface connecting the first major surface 34 and the flat end face 38. In the recording head of FIG. 29, the flat end face 38 is not perpendicular to the first and second major surfaces 34, 36 as in the recording heads of FIGS. 27 and 28. That is, the end face 38 is inclined with respect to the major surfaces 34, 36 such that an angle $\alpha$ between an extension line of the end face 38 and the second major surface 36 does not exceed 90°. The inclined flat end face 38 is covered by the heat-generating layer 46. The recording head of FIG. 30 is a modification of the head of FIG. 27. That is, the edge between the flat end face 38 and the flat inclined shoulder surface 40, and the edge between the end face 38 and the second major surface 36 are rounded, for smooth connection of the surfaces 40, 38 and 36. In the recording head of FIG. 31, the end face 38 is convexedly curved or rounded as a whole, contrary to the flat end face 38 in the heads of FIGS. 27–30. The heat-generating layer 46 follows this rounded end face 38 which connects the inclined shoulder surface 40 and the second major surface 36.

In the end-contact type thermal recording heads of FIGS. 27–31, therefore, the electrically resistive heat-generating layer 46 is formed on the end face 38 of the thin-walled distal end portion of the substrate 2 whose thickness is reduced as compared with the thickness at the proximal portion, in the presence of the shoulder surface 40 which is either inclined or curved so that the thickness of the thin-walled distal end portion continuously decreases in the direction from the proximal end toward the distal end (end face 38). This arrangement permits the heat-generating layer 46 to contact a heat-sensitive paper or thermally imaging ribbon, film or other intermediate medium, in a desired fashion, so that the heat generated by the heat-generating layer 46 can be effectively utilized for thermal recording. Further, the instant arrangement assures sufficiently high mechanical strength at the thin-walled end portion, allowing a sufficient contact pressure of the head with the recording medium or thermally imaging intermediate medium.

Figure 31:
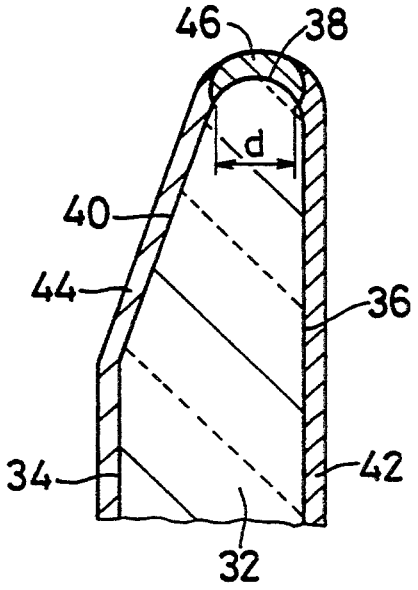

As described above, the end face 38 on which the heat-generating layer 46 is formed may be perpendicular to the major surfaces 34, 36 as shown in FIGS. 27, 28 and 30, or alternatively inclined with respect to the major surfaces 34, 36 as shown in FIG. 29. Further, the end face 38 may be either flat, or rounded or curved as shown in FIG. 31.

In the case where the end face 38 is inclined with respect to the second major surface 36 as shown in FIG. 29, the electrically resistive heat-generating film 46 may be formed or patterned by photolithography, concurrently with the formation of the recording electrodes 42 on the second major surface 36. It is also noted that the possibility of failure of electrical connection between the electrodes 42, 44 and the heat-generating portion 46 is advantageously lowered in the the recording heads of FIGS. 30 and 31 in which one end or both ends of the end face 38 is/are rounded, and in the recording head of FIG. 29 in which the angle $(180° - \alpha)$ between the end face 38 and the second major surface 36 is obtuse. Thus, the arrangements of FIGS. 29–31 assure a relatively high yield ratio of the recording head, namely, a relatively low reject ratio of the recording head.

While the heat-generating film 46 should be formed on the end face 38 of the thin-walled end portion of the ceramic substrate 2, the film 16 may be formed either after the electrodes 42, 44 are formed on the substrate 2 as in the case of FIG. 27, or before the electrodes 42, 44 are formed as in the cases of FIGS. 28–31.

The thickness "d" of the substrate 32 as measured at the end face 38 on which the heat-generating layer 46 is formed is selected within a range of about 10–400 $\mu$m, preferably within a range of about 20–100 $\mu$m, as in the preceding embodiments of FIG. 12–26, for the same reason as described above.

The ceramic substrate 32 used for the recording heads of FIGS. 27–31 is made of a material as described with respect to the embodiments of FIGS. 12–26.

Figure 32:
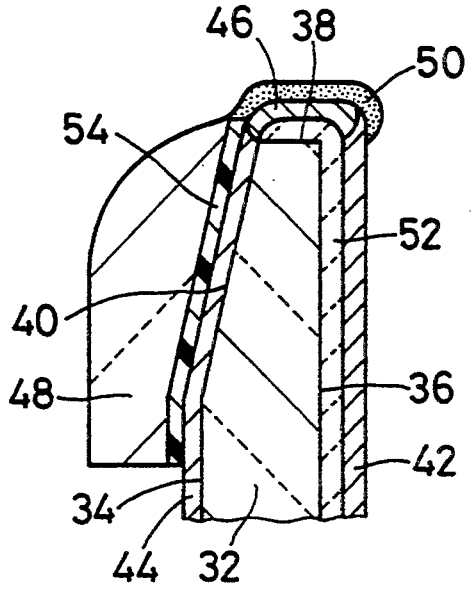
FIGS. 32 and 33 are fragmentary cross sectional views of further modifications of the embodiment of FIG. 27.
Figure 33:
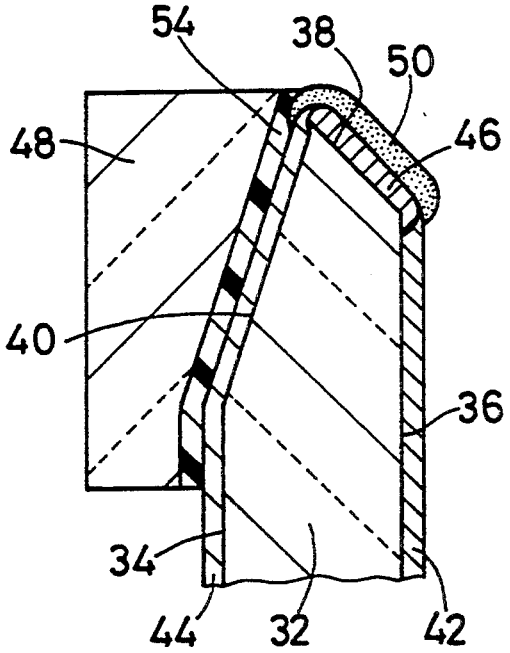

In the recording heads of FIGS. 27–31, too, a suitably reinforcing member 48 may be provided at the thin-walled end portion of the substrate 2 such that one end of the member 48 is located adjacent to the electrically resistive heat-generating layer 46, as shown in FIGS. 32 and 33. The reinforcing member 48 is bonded to the return-circuit electrode 44 by an adhesive layer 54. The reinforcing member 48 functions to increase the mechanical strength of the substrate 2 at its thin-walled end portion. If the reinforcing member 48 is made of a material having a high degree of thermal conductivity, the reinforcing member 48 also functions as a heat radiating member for radiating the heat generated by the heat-generating layer 46, thereby preventing blurring, blotting or expansion of image dots recorded, and distortion of the recorded image due to prolonged heat application from the layer 46 to the recording or intermediate medium.

The reinforcing member 48 is made of a material described above with respect to the embodiments of FIGS. 1–11. For improved heat radiation, it is desirable that the reinforcing member 48 be adapted for direct contact with the recording or intermediate medium.

In the embodiments of FIGS. 32 and 33, a protective layer 50 is formed so as to cover the electrically resistive heat-generating layer 46. The protective layer 50 is made of a material as described with respect to the protective layer 24 shown in FIGS. 9–11, and has the same function as the protective layer 24.

The recording and return-circuit electrodes 34, 36 and the heat-generating film 46 are made of suitable materials as described above with respect to the electrodes 4, 6 and heat-generating portion 8 in the embodiments of FIGS. 1–11. The description of the thickness of the electrodes 4, 6 applies to the electrodes 34, 36 of the heads of FIGS. 27–33.

The width of the heat-generating layer 46 as measured in the direction of thickness of the substrate 32 need not be the same as the width "d" of the thin-walled end portion of the substrate 32, i.e., may be smaller than "d", or larger than "d" if necessary, so that the layer 46 covers also the end faces of the electrodes 34, 36, as shown in FIG. 27.

In the embodiment of FIG. 32, a glaze layer 52 is formed so as to cover the end face 38 and the second major surface 36, so that the heat-generating layer 46 and recording electrodes 42 are subsequently formed on the glaze layer 52.

The recording head of FIG. 33 is more or less similar to the recording head of FIG. 32, but is different therefrom in that the end face 38 is inclined with respect to the major surfaces 34, 36 and the heat-generating layer 46 and recording electrodes 42 are formed directly on the ceramic substrate 32, without a glaze layer as provided in the head of FIG. 32.

Referring next to FIGS. 34–37, there will be described still further embodiments of the end-contact type thermal recording head of this invention.

In FIGS. 34–37, reference numeral 60 designates a ceramic substrate 60 which has a thin-walled end portion. The substrate 60 has a multiplicity of recording electrodes 62 in the form of strips formed on one of its opposite major surface, and a common return-circuit electrode 64 in the form of a sheet formed on the other major surface. The thin-walled end portion of the substrate 60 has an end face on which is formed a heat-generating portion consisting of electrically resistive films 66. The recording and return-circuit electrodes 62, 64 are electrically connected to the electrically resistive films 66. A heat radiating member 68 is bonded by an adhesive layer 70 to the common return-circuit electrode 64, such that one end of the heat radiating member 68 is located adjacent to the end face of the thin-walled end portion of the substrate 60.

Figure 34:
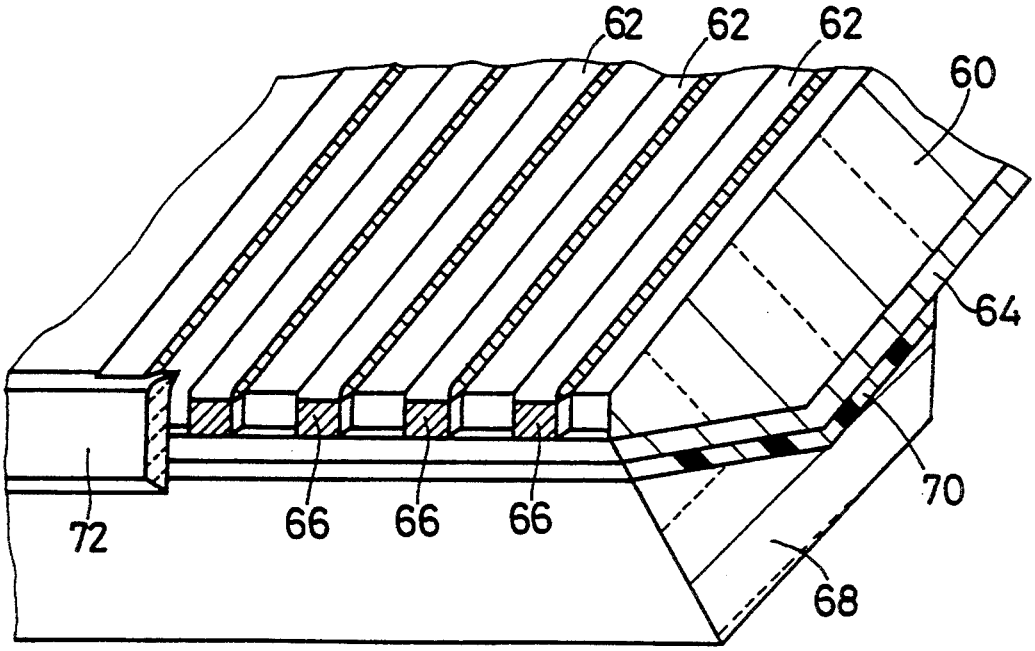
FIG. 34 is a fragmentary perspective view showing a yet another-embodiment of the end-contact type thermal recording head of the invention.
Figure 35:
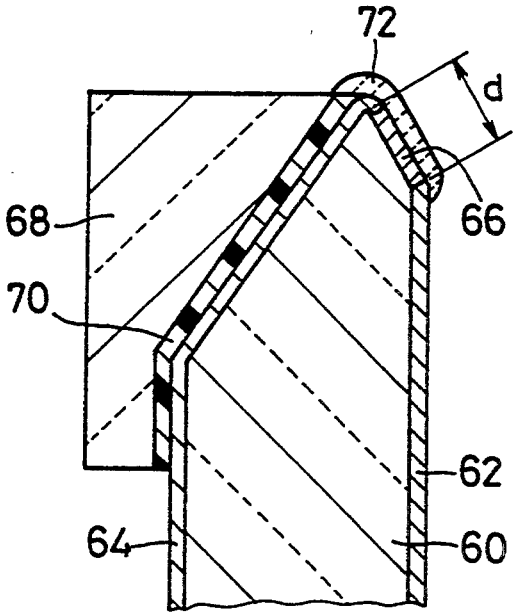
FIG. 35 is a fragmentary cross sectional view of the recording head of FIG. 34.

In the embodiment of FIGS. 34 and 35 which is structurally similar to the recording head of FIG. 33, the thin-walled end portion of the ceramic substrate 60 is partially defined by a flat inclined surface which extends from the major surface on which the return-circuit electrode 64 is formed. The inclined surface approaches the other major surface on which the recording electrodes 66 are formed. The heat radiating member 68 is formed so as to cover the inclined surface and an end portion of the major surface from which the inclined surface extends. As in the embodiment of FIG. 33, the end face on which the electrically resistive films 66 are formed is inclined to form an obtuse angle between an extension line of the end face and the major surface on which the recording electrodes 62 are formed. The electrically resistive films 66 are covered by a protective layer 72.

Figure 36:
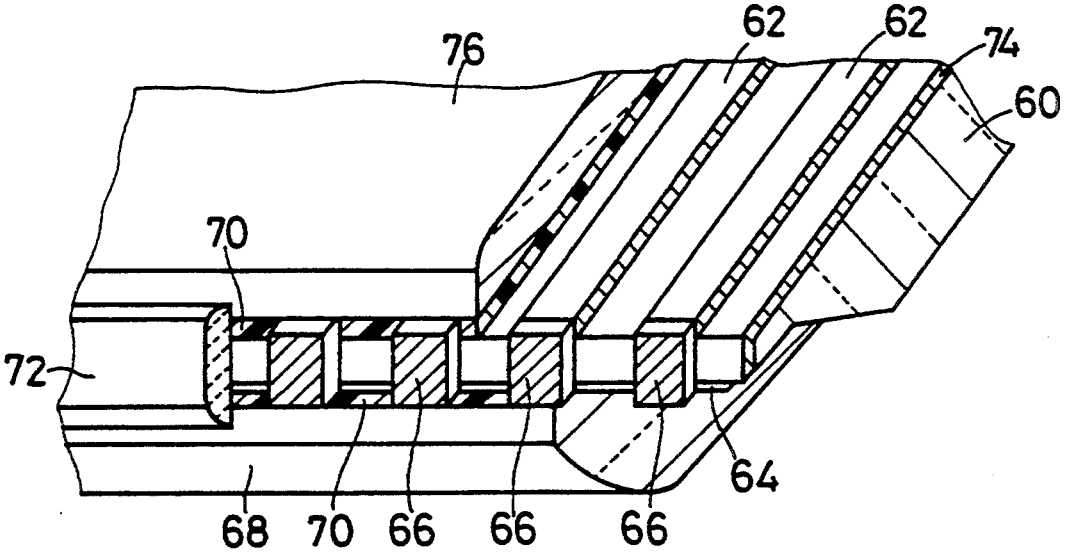
FIG. 36 is a fragmentary perspective view showing a still another embodiment of the invention.
Figure 37:
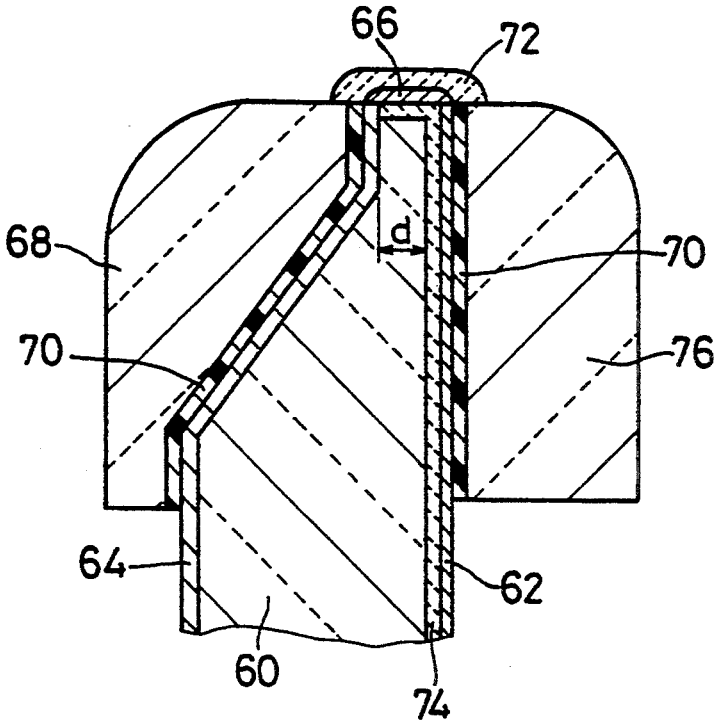
FIG. 37 is a fragmentary cross sectional view of the recording head of FIG. 36.

In the embodiment of FIGS. 36 and 37, the substrate 60 has the same configuration as the substrate 2 of FIG. 2, and has a glaze layer 74 covering the end face of the thin-walled end portion and one of the opposite major surfaces, as in the embodiment of FIG. 32. The electrically resistive films 66 and the recording electrodes 62 are formed on the respective portions of the glaze layer 74 which cover the end face and the above-indicated one major surface. The common return-circuit electrode 64 formed on the other major surface and the recording electrodes 62 are electrically connected to the electrically resistive films 66 formed on the end face. As in the preceding embodiment of FIGS. 34, 35, the heat radiating member 68 is disposed in contact with the return-circuit electrode sheet 64, while a reinforcing member 76 is provided in contact with the recording electrodes 62, for increasing the mechanical strength of the thin-walled end portion of the substrate 60. 10 The heat radiating and reinforcing members 68, 76 are bonded by respective adhesive layers 70. In this embodiment, too, the films 66 are covered by the protective layer 72.

While the end portion of the substrate having the end face is shaped differently in the embodiment of FIGS. 34 and 35 and the embodiment of FIGS. 36 and 37, the configuration of the thin-walled end portion may be suitably selected. The thin-walled end portion of the substrate 60 of FIGS. 34, 35 having the inclined surface terminating directly in the end face has a relatively large mechanical strength, which permits the films 66 to be pressed onto a heat-sensitive paper or a thermally imaging film or ribbon with a relatively high contact pressure. In the embodiment of FIGS. 36 and 37, the thin-walled end portion of the substrate 60 has a constant thickness portion having the end face, and a varying thickness portion partially defined by an inclined surface which forms an obtuse angle with respect to the major surface on which the return-circuit electrode. 64 is formed. However, the inclined surface may be replaced by a shoulder surface which is perpendicular to the major surfaces as in the embodiment of FIG. 3, or a curved surface as in the embodiment of FIG. 28.

The thickness "d" of the substrate 60 as measured at the end face on which the electrically resistive films 66 are formed is selected within a range of about 10–400 μm, preferably within a range of about 20–100 μm, as in the preceding embodiments of FIG. 12–33, for the same reason as described above with respect to the embodiments of FIGS. 12–26.

In the embodiments of FIGS. 34–37, the ceramic substrate 60 is made of a material whose thermal conductivity is lower than that of the heat radiating member 68 and falls within a range between 0.002 cal.cm/sec.cm$^2$°C. and 0.03 cal.cm/sec.cm$^2$°C., preferably within a range between 0.002 cal.cm/sec.cm$^2$°C. and 0.01 cal.cm/sec.cm$^2$.°C. More preferably, the material for the substrate 60 whose thermal conductivity falls within the range specified above has a heat capacity of not higher than 0.55 cal/°C..cm$^3$ per unit volume. The thermal characteristics of the thin-walled head portion of the substrate 60 can be controlled by suitably selecting the material of the substrate having the thermal properties indicated above. For instance, the ceramic substrate 60 may be made of a glass ceramic material, a highly machinable or free-cutting glass ceramic material, or a free-cutting glass ceramic containing mica. While the material of the substrate 60 is determined depending upon the thermal conductivity of the heat radiating member 28 used, a free-cutting glass ceramic material containing mica is most preferred.

Namely, the ceramic substrate 60 is required to exhibit a suitable degree of heat accumulating property in order to concentrate efficiently the generated heat on the desired local spots on the recording medium or thermally imaging intermediate medium. In this respect, the substrate 60 is preferably formed of a free-cutting glass ceramic material containing mica, since its heat accumulating ability is higher than those of alumina and aluminum nitride, and is lower than that of a glass material having a relatively low thermal conductivity. The free-cutting glass ceramic material containing mica is also preferred for fast rise of the temperature of the substrate 60 and effective utilization of the heat generated by the electrically resistive films 66, since its heat capacity per unit volume is smaller than that of alumina and metals. The suitable selection of the material of the substrate 60 permits a desired heat-generating response of the head, i.e., a desired heat transfer from the electrically resistive films 66 to the recording medium or thermally imaging intermediate medium, so that the quality of images recorded by the head is improved. The free-cutting glass ceramic material containing mica is advantageous for easy and accurate formation of the thin-walled end portion of the substrate 60, where the substrate 60 is mechanically cut or machined to form the thin-walled end portion.

As described above with respect to the preceding embodiments, a glaze layer as indicated at 74 in FIGS. 36 and 37 may be eliminated where a glass ceramic material is used for the substrate 60. The heat radiating member 68 disposed adjacent to the electrically resistive films 66 on the end face of the thin-walled end portion of the substrate 60 is made of a material whose thermal conductivity is not lower than 0.01 cal.cm-/sec.cm$^2$.°C. The heat radiating member 68 having such thermal conductivity is effective to radiate efficiently the heat generated by the electrically resistive films 66, thereby preventing blurring or blotting or expansion of image dots recorded by the head. Although the heat radiating member 68 is desirably used together with the substrate 60 whose thermal conductivity falls within the range specified above, the thermal conductivity of the substrate material need not fall within the specified range, provided the thermal conductivity of the heat radiating member 68 is not lower than 0.01 cal.cm-/sec.cm$^2$.°C.

The heat radiating member 68 is made of a material as described with respect to the heat radiating member 26 in FIGS. 12–17 and 21–26. For improved heat radiation, it is desirable that the heat radiating member 68 be adapted for direct contact with the recording or intermediate medium. The reinforcing member 76 is made of a material described above with respect to the embodiments of FIGS. 1–11.

The adhesive layers 70, protective layer 72 and glaze layer 74 are similar to the adhesive layers 10, protective layer 24, and glaze layer 14 which have been described above. The recording and return-circuit electrodes 62, 64 and the electrically resistive films 66 are made of the materials as described with respect to the electrodes 4, 6 and the electrically resistive films 8.

The width of the heat-generating films 66 need not be the same as the width "d" of the end face of the thin-walled end portion of the substrate 60. Further, the angle and shape of the end face carrying the films 66 relative to the major surfaces of the substrate 60, and the configuration of the thin-walled end portion of the substrate 60 are not limited to those of FIGS. 35 and 37. For instance, the end face may be a convex surface or have rounded ends.

Figure 38:
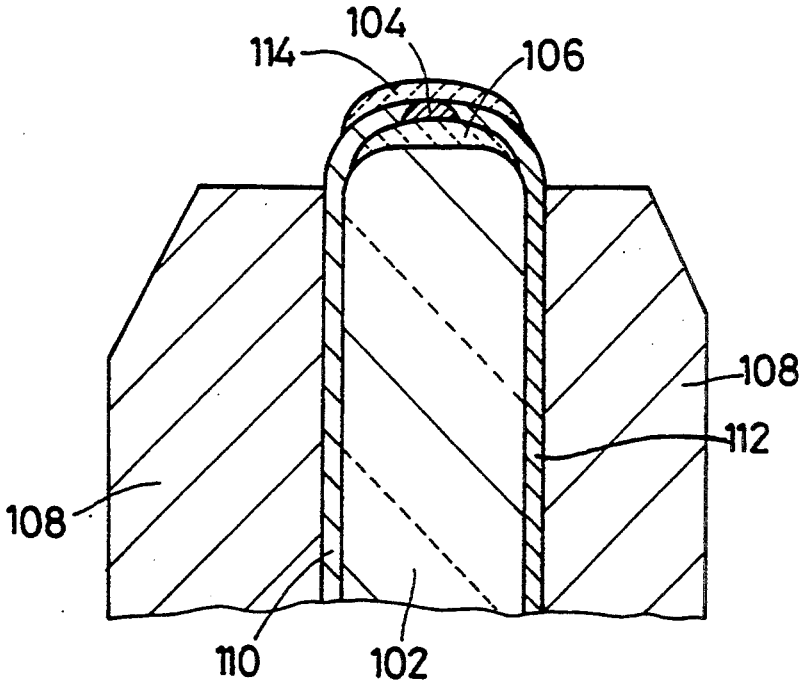
FIG. 38 PRIOR ART
FIG. 38 is a known end-contact type thermal recording head.

Five end-contact type thermal recording heads were prepared for comparison of the recording heads of FIGS. 34–35 and FIGS. 36–37 as Examples 1 and 2 with Comparative Examples 3, 4 and 5. The recording heads according to Comparative Examples 3 and 4 are structurally identical with the heads according to Examples 1 and 2, but use a ceramic substrate whose thermal conductivity does not fall within the range specified above. The recording head according to Comparative Example 5 is a known head as shown in FIG. 38. The thermal conductivity of the substrate and the heat radiating member of Examples 1–5 are indicated in Table 1 below.

TABLE 1

| Example No. | Type of Head | Thermal Conductivity * Substrate | Heat Radiator | Remarks |
|---|---|---|---|---|
| 1 | FIGS. 34–35 | 0.008 | 0.04 | Invention |
| 2 | FIGS. 36–37 | 0.004 | 0.02 | Invention |
| 3 | FIGS. 34–35 | 0.001 | 0.004 | Comparative |
| 4 | FIGS. 36–37 | 0.04 | 0.04 | Comparative |
| 5 | FIG. 38 | 0.002 | No radiator | Comparative |

*: Unit = cal · cm/sec · cm$^2$ · °C.

The thermal recording heads of Examples 1–5 were tested for quality of images recorded. The recording heads of Examples 1 and 2 according to the present invention were capable of recording high-quality images at a high speed, without undesirable blurring or expansion of image dots, or without distortion of the images due to prolonged heat application from the head.

On the other hand, the recording heads of Comparative Examples 3 and 5 suffered from blurring or expansion of image dots, and distortion of the images due to the prolonged heat application from the head, which are considered to arise from the heat accumulation in the head. The resolution and clarity of the recorded images were not satisfactory. The recording head of Comparative Example 4 suffered from low image reproduction sensitivity and low density of the recorded images.

While the the present invention has been described in its presently preferred embodiments by reference to the accompanying drawings, with a certain degree of particularity, it is to be understood that the invention is not limited to the details of the illustrated embodiments, but may be embodied with various changes, modifications and advantages, which may occur to those skilled in the art, in the light of the foregoing teachings.

What is claimed is:

1. An end-contact type thermal recording head comprising:

a ceramic substrate having a thick-walled proximal portion and a thin-walled end portion extending from said thick-walled proximal portion, said thin-walled end portion having a thickness smaller than said thick-walled proximal portion;

an electrically resistive heat-generating portion covering at least an end face of said thin-walled end portion such that said heat-generating portion traverses an entire thickness of said thin-walled end portion;

a plurality of recording electrodes; and a return-circuit electrode formed on said substrate and electrically connected to said heat-generating portion to energize said heat-generating portion, said thin-walled end portion having a heat accumulating property to utilize effectively heat generated by said heat-generating portion for thermal recording by the head at said thin-walled end portion through said recording and return-circuit electrodes; and a heat radiating member disposed on one of opposite sides of said ceramic substrate which correspond to opposite major surfaces of the substrate, such that a portion of said heat radiating member is located at said thin-walled end portion of said ceramic substrate, said heat radiating member having a thermal conductivity higher than that of said substrate, for efficient radiation of heat generated by said heat-generating portion and accumulated in said thin-walled end portion.

2. An end-contact type thermal recording head according to claim 1, wherein said return-circuit electrodes consist of a common return-circuit electrode sheet, and said heat radiating member is bonded to said common return-circuit electrode sheet.

3. An end-contact type thermal recording head according to claim 1, wherein said heat radiating member is disposed in contact with said plurality of recording electrodes.

4. An end-contact type thermal recording head according to claim 1, wherein said heat radiating member is made of a material having at least one major component selected from a group consisting of free-cutting glass ceramic, free-cutting glass ceramic containing mica, free-cutting alumina, free-cutting boron nitride, free-cutting aluminum nitride, brass, copper, aluminum and bronze.

5. An end-contact type thermal recording head according to claim 1, wherein a thickness of said thin-walled end portion of said ceramic substrate as measured at said end face is held within a range of 10–400 μm.

6. An end-contact type thermal recording head according to claim 5, wherein said thickness of said thin-walled end portion of said ceramic substrate is held within a range of 20–100 μm.

7. An end-contact type thermal recording head according to claim 1, wherein said return-circuit electrode consists of a common return-circuit electrode in the form of a sheet bonded to one of said major surfaces of said ceramic substrate.

8. An end-contact type thermal recording head according to claim 7, wherein said common return-circuit electrode functions as said heat radiating member.

9. An end-contact type thermal recording head according to claim 1, wherein said ceramic substrate is comprised of free-cutting glass ceramic containing mica.

10. An end-contact type thermal recording head according to claim 1, wherein said heat-generating portion is formed directly on said end face of said thin-walled end portion of said ceramic substrate.

11. An end-contact type thermal recording head comprising:

a ceramic substrate having a thin-walled end portion;

an electrically resistive heat-generating portion provided on the thin-walled end portion of the substrate, said heat-generating portion traversing an entire thickness of said thin-walled end portion;

recording and return-circuit electrodes electrically connected to said heat-generating portion to energize the heat-generating portion; and a heat radiating member disposed such that a portion of said heat radiating member is adjacent to said electrically resistive heat-generating portion, to radiate heat generated by said heat-generating portion, said ceramic substrate being comprised of a material having a thermal conductivity which is lower than that of a material of said heat radiating member and which falls within a range between 0.002 cal.cm/sec.cm$^2$.°C. and 0.03 cal.cm/sec.cm$^2$.°C., such that said thin-walled end portion has a heat accumulating property to utilize effectively heat generated by said heat-generating portion for thermal recording by the head at said thin-walled end portion.

12. An end-contact type thermal recording head according to claim 11, wherein said thermal conductivity of said material of said ceramic substrate falls within a range between 0.002 cal.cm/sec.cm$^2$.°C. and 0.01 cal.cm/sec.cm$^2$.°C.

13. An end-contact type thermal recording head according to claim 12, wherein said heat radiating member is comprised of a material having a thermal conductivity which is higher that of said material of said ceramic substrate and which is higher than 0.01 cal.cm/sec.cm$^2$.°C.

14. An end-contact type thermal recording head according to claim 11, wherein said material of said ceramic substrate has a heat capacity of not higher than 0.55 cal/°C..cm$^3$.

15. An end-contact type thermal recording head comprising:

a ceramic substrate having a thin-walled end portion;

an electrically resistive heat-generating portion provided on said thin-walled end portion of the substrate, said heat-generating portion traversing an entire thickness of said thin-walled end portion;

recording and return-circuit electrodes electrically connected to said heat-generating portion to energize the heat-generating portion, said thin-walled end portion having a heat accumulating property to utilize effectively heat generated by said heat-generating portion for thermal recording by the head at said thin-walled end portion through said recording and return-circuit electrodes; and a heat radiating member disposed such that a portion of said heat radiating member is adjacent to said electrically resistive heat-generating portion to radiate heat generated by said heat-generating portion, said heat radiating member being comprised of a material having a thermal conductivity which is higher than that of a material of said ceramic substrate and which is higher than 0.01 cal.cm/sec.cm$^2$.°C., for efficient radiation of heat generated by said heat generating portion.

16. An end-contact type thermal recording head comprising:

a ceramic substrate having a thin-walled end portion;

an electrically resistive heat-generating portion provided on the thin-walled end portion of the substrate, said heat-generating portion traversing an entire thickness of said thin-walled end portion;

recording and return-circuit electrodes electrically connected to said heat-generating portion to energize the heat-generating portion; and a heat radiating member disposed such that a portion of said heat radiating member is adjacent to said electrically resistive heat-generating portion, to radiate heat generated by the heat-generating portion, said ceramic substrate being comprised of a material having a thermal conductivity selected within a range between 0.002 cal.cm/sec.cm$^2$.°C. and 0.01 cal.cm/sec.cm$^2$.°C., and a heat capacity of not higher than 0.55 cal./°C..cm$^3$, such that said thin-walled end portion has a heat accumulating property to utilize effectively heat generated by said heat-generating portion, for thermal recording by the head at said thin-walled end portion, a thermal conductivity of the material of said heat radiating member being higher than 0.01 cal.cm- /sec.cm$^2$.°C., for efficient radiation of heat generated by said heat-generating portion.

17. An end-contact type thermal recording head comprising:

a ceramic substrate having a thin-walled end portion;

an electrically resistive heat-generating portion formed directly on an end face of said thin-walled end portion of the substrate, so as to traverse an entire thickness of said thin-walled end portion;

recording and return-circuit electrodes electrically connected to said heat-generating portion to energize the heat-generating portion; and a heat radiating member disposed such that a portion of said heat radiating member is adjacent to said electrically resistive heat-generating portion, to radiate heat generated by the heat-generating portion, said ceramic substrate being comprised of a material having a thermal conductivity which is lower than that of a material of said heat radiating member and which falls within a range between 0.002 cal.cm/sec.cm$^2$.°C. *and* 0.03 cal.cm/sec.cm$^2$.°C., such that said thin-walled end portion has a heat accumulating property to utilize effectively heat generated by said heat-generating portion, for thermal recording by the head at said thin-walled end portion.

18. An end-contact type thermal recording head comprising:

a ceramic substrate including a thin-walled end portion having an end face, said thin-walled end portion having a thickness within a range of 10–400 μm as measured at said end face;

an electrically resistive heat-generating portion covering at least said end face of said thin-walled end portion such that said heat-generating portion traverses an entire thickness of said thin-walled end portion;

recording and return-circuit electrodes formed on said substrate and electrically connected to said heat-generating portion to energize said heat-generating portion, said thin-walled end portion having a heat accumulating property to utilize effectively heat generated by said heat-generating portion for thermal recording by the head at said thin-walled end portion through said recording and return-circuit electrodes; and a heat radiating member disposed on one of opposite sides of said ceramic substrate which correspond to opposite major surfaces of the substrate, such that a portion of said heat radiating member is located at said thin-walled end portion of said ceramic substrate, said heat radiating member having a thermal conductivity higher than that of said substrate, for efficient radiation of heat generated by said heat-generating portion.

19. An end-contact type thermal recording head according to claim 18, wherein said thickness of said thin-walled end portion is within a range of 20–100 μm.

20. An end-contact type thermal recording head according to claim 18, wherein said ceramic substrate further includes a thick-walled proximal portion from which said thin-walled end portion extends, said thick-walled proximal portion having a thickness larger than that of said thin-walled end portion.

* * * * *